US011179829B2

(12) United States Patent
Buchanan

(10) Patent No.: US 11,179,829 B2
(45) Date of Patent: Nov. 23, 2021

(54) RATCHET WRENCHES

(71) Applicant: Nigel Buchanan, Fife (GB)

(72) Inventor: Nigel Buchanan, Fife (GB)

( * ) Notice: Subject to any disclaimer, the term of this patent is extended or adjusted under 35 U.S.C. 154(b) by 83 days.

(21) Appl. No.: 16/775,812

(22) Filed: Jan. 29, 2020

(65) Prior Publication Data

US 2020/0223035 A1 Jul. 16, 2020

Related U.S. Application Data

(63) Continuation of application No. 15/773,731, filed on May 4, 2018, now abandoned.

(51) Int. Cl.
*B25B 13/46* (2006.01)

(52) U.S. Cl.
CPC ..... *B25B 13/462* (2013.01)

(58) Field of Classification Search
CPC ..... B25B 13/46; B25B 13/461; B25B 13/462; B25B 13/463; B25B 13/465
USPC ..... 81/59.1, 58.3, 58.4, 60
See application file for complete search history.

(56) References Cited

U.S. PATENT DOCUMENTS

| | | | | |
|---|---|---|---|---|
| 7,197,964 | B2 * | 4/2007 | Buchanan | B25B 13/462 81/58 |
| 7,237,459 | B1 * | 7/2007 | Shiao | B25B 13/465 81/62 |
| 2005/0115366 | A1 | 6/2005 | Chaconas | |
| 2013/0340574 | A1 | 12/2013 | Buchanan | |

FOREIGN PATENT DOCUMENTS

| | | | |
|---|---|---|---|
| DE | 202012104590 | U1 | 5/2013 |
| FR | 598783 | A | 12/1925 |
| GB | 648163 | A | 12/1950 |
| GB | 2399782 | A | 9/2004 |

OTHER PUBLICATIONS

International Search Report for corresponding International application No. PCT/GB2016/053445, dated Feb. 20, 2017, 2 pages.
International Search Report for corresponding International application No. PCT/GB2016/053460, dated Feb. 20, 2017, 2 pages.
International Search Report for corresponding International application No. PCT/GB2016/053437, dated Feb. 20, 2017, 2 pages.
International Search Report for corresponding International application No. PCT/GB2016/053461, dated Feb. 20, 2017, 2 pages.

* cited by examiner

*Primary Examiner* — Orlando E Aviles
*Assistant Examiner* — Robert F Neibaur
(74) *Attorney, Agent, or Firm* — Patterson Intellectual Property Law, PC; Emily A. Shouse

(57) ABSTRACT

The ratchet 1 is designed such that the flexible clutch ring 500 forms the mid part of an extremely strong laminate like housing 200 structure, under torque conditions the resultant compression forces applied to the clutch ring 500 are substantially dissipated around its circumference 507 and inner surface 508, this inward force clamping upon the inherently strong drive outer surface 405. The resultant pseudo laminate like construction of the drive 400, clutch 500 and housing 201, 202 enables a proportionately far stronger reduced width ratchet 1.

21 Claims, 21 Drawing Sheets

RATCHET WRENCHES

FIELD OF THE INVENTION

The invention relates to wrench ratchet mechanisms and ratchet wrenches (often referred to in the United Kingdom as spanners), also roller or sprag clutches used as one way mechanisms or selective circular drives.

BACKGROUND TO THE INVENTION wrench head wrench head Known ratchet wrenches may comprise a wrench head that houses a driven member. The driven member may be provided with an aperture shaped to receive an item that is to be driven. For example, the aperture may be a hexagonal aperture sized to receive a particular size of fastener head/nut. Alternatively, the driven member may comprise a spigot that projects from the wrench head to allow the wrench head to be connected to a drive socket or the like. A resilient annular clutch may be disposed between the wrench head and driven member to transmit an applied torque from the wrench head to the driven member. When the wrench handle is turned in the drive direction to apply a torque to a fastener of the like, the clutch is deformed to lock the wrench head to the driven member to transmit the torque. When the wrench handle is turned in the opposite direction, the clutch springs back to allow relative movement of the wrench head and driven member to all repositioning of the wrench handle.

In order to avoid having an overly large wrench head, the resilient annular clutch may be a relatively thin sprung ring, which when subjected to repeated high torques is deformed to such an extent it becomes ineffective.

The annular clutch may have a series of fine teeth on its outer side to engage correspondingly fine teeth on the wrench head. There may for example be at least one hundred teeth on the annular clutch. Since such teeth are relatively fine, even a small amount of deformation of the annular clutch, for example as little as 0.01% makes it particularly likely to fail properly engage the teeth on the wrench head. Manufacturing a relatively thin annular clutch with fine teeth is not straightforward. One potential manufacturing method is metal injection moulding MIM. MIM parts are moulded from metal particles held together with a percentage of plasticiser or wax. The moulded parts are subjected to a very high temperature in a vacuum oven during which the metal particles fuse and the plasticiser is burnt and vacuumed off. Even differences as small as 0.02% in the process produces variations in the finished size that may cause misalignment of the teeth when the annular clutch ring is forced into engagement with the wrench head.

A further problem with such ratchet wrenches is that the ingress of fine dust or grit quickly fouls the ratchet mechanism.

It is an object of the invention to at least partially alleviate the above mentioned problems, or to provide an alternative to existing products.

SUMMARY OF THE INVENTION

The invention provides a ratchet wrench as specified in the claims.

In some embodiments an end of the handle has a through-bore for the axle or pivot pin and a protrusion or inversely a recess with abutment ends for the engagement of the clutch ring ends. The end of the handle may have a biasing profile for interaction with at least one spring and ball detent, the sprung detent acting to provide a direction bias and the initial grip in the required drive direction of the clutch ring upon the central drive. In the devices rest position, the partially compressed springs transmit their resilient force via the detent balls and handle levered end actuator to the clutch ring in order to provide the necessary initial clamping of the clutch ring and to obviate any slack or play inherent in normal ratchets.

When the handle is further operated in the drive or locking direction, the partially toothed and smooth inner surface of the clutch having initially resiliently clamped the corresponding toothed profile of the circumferential surface of the driven member in order that when additional torque is applied in the drive direction to the handle portion, the said clutch portion is further urged inwards as the clutch ramp protrusions usefully engage the corresponding inner housing ramps, further propelling the inner surface of the clutch ring inwards upon the outer surface of the central drive portion enabling the engaged fastener to be robustly driven. In order to optimise the clutches initial inner surface grip upon the corresponding drive portion outer circumference the toothed portion of the clutch has profiles which interlock with the similar pitch and profile of the drive teeth.

When the handle is operated in the reverse or reposition direction, the actuator releases its initial or direction biasing force against the abutting clutch actuation face alleviating the biasing springs resilient force partially freeing the clutch inner surface from the drive portion. The action of the drive portion being rotated against any clamping friction of the clutch ring further rotates the clutch outer ramps away from the corresponding housing ramps allowing the clutch ring to expand further, negating the grip of the clutch ring upon the driven member drive surface, usefully allowing the drive portion or shaft to be reversed or repositioned. The magnitude of the clutch engaging spring force is directionally proportionate to that of the detent resilient portion, to that end the clutch ring generally requires to be thin in section and made from resilient material like high grade spring steel.

The device is designed such that the clutch ring forms the mid part of an extremely strong laminate like structure, under torque conditions, the resultant compression forces applied to the clutch ring are substantially dissipated around its circumference. The resultant pseudo laminate like construction of the drive, clutch, and housing enables a proportionately far stronger or alternately a thinner lighter device.

The present invention even further comprises a ratchet mechanism, wherein if the outer radiuses of the drive teeth have minimal radius, their locking engagement with the smooth section of the intermediate's inner sidewall will be measurably enhanced.

The invention may comprise a ratchet mechanism, wherein the optimum placement of the clutch toothed portion is at or near the clutch tail portion outer surface. In use, the tail portion at the end with the actuator engagement provides the initial clutch engagement with the drive teeth, the remainder of the clutch ring being pulled from that point around the drive teeth periphery by the clutch ramps further engagement with the housing ramps providing the optimum locking engagement of the clutch inner surface and the drive outer surface.

The invention may comprises a ratchet mechanism wherein the working inner surfaces of the clutch ring against the drive circumference and housing ramps can usefully be lubricated in order to prevent any undue frictional wear during reverse or repositioning, whilst incurring negligible loss of maximum levels of torque.

The invention may comprise a ratchet mechanism wherein the size and shape of the housing ramps and corresponding outer clutch periphery transmission ramps are chosen to ensure that they cannot completely disengage from one another when the ratchet is used in the reverse direction.

The invention may comprise a ratchet mechanism wherein the drive incorporates a fastener engaging profile to enable use as a ratcheting wrench or configured to be used as a bit holder for use with corresponding drive bits.

The invention may comprise a ratchet mechanism wherein in order to achieve utmost drive tooth contact with the inner sidewall of the clutch, it is desirable that the innermost circumferential profile of both the toothed section, and smooth section of the clutch sidewall are identical. To that end, the clutch's inner smooth section profile is substantially the same as the inner height of the teeth of the toothed section, a further aid being the tops of the outer toothed wall of the drive portion are preferably radiused or near flat topped, the "flat top" being substantially the same circumferential profile as the inner sidewall of the clutch's smooth section.

The invention when utilised in the drive or locking direction whereas the initial engagement between the clutch's toothed section and the drive's toothed outer wall cause the clutch outer sidewall ramps or cams to engage upon the head chamber's corresponding ramps or cams urging the said clutch inwards, robustly engaging the toothed and smooth sections of the inner clutch sidewall upon the corresponding drive portion outer sidewall teeth and teeth tops.

The invention may comprise a ratchet mechanism wherein if the outer tips of the drive teeth have minimal radius's, their locking engagement with the smooth section of the clutch inner sidewall will be measurably enhanced.

The invention may comprise a ratchet mechanism, wherein the operating angles of the housing ramps and the clutch transmission ramps are between 8 to 30 degrees.

The invention may comprise a ratchet mechanism wherein the useful enhancement of having only a partially toothed engagement portion between the clutch inner surface and the toothed outer surface of the drive element substantially reduces the problem of the clutch elongation in use or problematic manufacturing teeth mismatch thereby reducing the manufacturing and warranty costs.

The invention may comprise a ratchet mechanism wherein the parts of the wrench head are constructed in a quasi-laminate manner. This structure provides the method whereby we can achieve an inherently stronger mechanism thus permitting superior torque and useful head size reduction. Laminates are inherently stronger than similar thickness materials due to the utilisation of using metal grain structures in dissimilar grain directions (cross grain).

The invention may comprise a ratchet mechanism wherein the match between the clutch toothed portion, and the clutch smooth portion profiles as they mesh with the drive toothed profile when operated in the drive direction ensures a pseudo laminate-like construction. The housing ramps also matching the transmission ramps in a similar manner, the role of the drive ramps are to equalise the compression and stresses imparted upon the clutch and drive portions in an inward direction i.e. compression in the drive direction. When the wrench is operated in the reverse or reposition direction, the clutch ring ramps move down the housing ramps within the confines of the housing ramp walls and the clutch transmission ramp shoulders which usefully restrict the gap created when they abut, further permitting clutch ring expansion into the said gap which provides delamination during the reverse action allowing the now lightly engaged clutch toothed portion to effortlessly traverse over the drive teeth.

The invention may comprise a ratchet mechanism wherein the wrench head width can be usefully reduced allowing the operation of the ratchet in situations unavailable to other prior art ratchets, whilst still passing the relevant torque standards.

The invention may comprise a ratchet mechanism wherein at rest the clutch toothed portion is already biased into the corresponding drive teeth by the detent springs in order to provide as far as possible instantaneous engagement with the drive teeth in such a way to be meshed in circumferential unison when utilized in the wrench drive direction.

The invention may comprise a ratchet mechanism wherein the handle is affixed the wrench head and the direction switch is biased by a rotational switch biasing protrusion.

The invention may comprise a ratchet mechanism wherein the wrench head enclosure strength is enhanced by the use of protrusions and recesses placed strategically around the housing aperture. The protrusions or their corresponding recesses can be on either housing face, fitting snugly into one another they provide the housing with the ability to be substantially reduced in profile yet retain strength and robustness.

The invention may comprise a ratchet mechanism wherein the wrench head strength is enhanced by the fact that the main locking forces are directed inwards upon the extremely strong drive element circumference further reducing the need for thick housing walls.

The invention may comprise a ratchet mechanism wherein the top and bottom housings are secured against one another by a snap ring type retainer within a retaining clip channel within the drive element. The drive element having a further retaining flange.

The invention may comprise a ratchet mechanism wherein the top and bottom housings are secured against one another by rivet upstands incorporated within the top or bottom housings, the opposing housing having a countersunk hole for the retention of the rivet head profile. By incorporating the rivet fixing within the housing moulding and thereby virtually obviating the chance of a separate rivet or screw coming loose from the wrench head the ratchet wrench is ideal for use in the aerospace industry as the incidence of foreign objects being left in problem areas is further reduced.

The invention may comprise a ratchet mechanism wherein to further reduce costs and inventory, the top and bottom housings can be produced as mirror copies of one another. One side of the housing having housing closure holes, the other side having corresponding housing closure protrusions, one fitting into the other. The manufacturing method in one example can be by precision metal injection moulding MIM. The Fixings could be by rivets within countersunk holes, the rivets usefully having centre holes for the ease of precision splaying.

The invention may comprise a ratchet mechanism wherein the top and bottom housings, the clutch ring, and the drive element are ideal for production using a process termed metal injection moulding MIM. This process allows the parts to be mass produced in great numbers with great precision, the drive teeth can easily be over 120 in number whilst the profiles of the teeth remain accurate.

The invention may comprise a ratchet mechanism wherein the clutch has its engaged actuation faces on the opposite tail portions, meaning that the clutch is pulled around the housing inner surface in the first instance, not pushed as previously shown. The handle levered end actuators being further recessed.

The invention may comprise a ratchet mechanism wherein to protect the interior of the ratchet mechanism from dirt and debris the housing incorporates a retaining profile for the retention of dust seals made from flexible material such as silicon rubber, the profile of that portion which seals against the handle has a hollow interior which aids the resilient seal of the housing opening.

The invention may comprise a ratchet mechanism wherein in order to further reduce its overall working depth the drive spigot can be of a reduced height compared to the standard or prior art. The further use of compatible low profile sockets would greatly increase the present inventions usefulness in areas of restricted access.

The invention may comprise a ratchet mechanism wherein the wrench head housing width for a ¼ inch square drive is less than 19 mm.

The invention may comprise a ratchet mechanism wherein the wrench head housing width for a ¼ inch square drive is less than 17 mm.

The invention may comprise a ratchet mechanism wherein the wrench head housing width for a ⅜ inch square drive is less than 22 mm.

The invention may comprise a ratchet mechanism wherein the wrench head housing width for a ½ inch square drive is less than 27 mm.

The invention may comprise a ratchet mechanism wherein the wrench head housing width for a ½ inch square drive is less than 25 mm.

The invention may comprise a ratchet mechanism wherein the inner surface of the clutch ring is substantially toothed. The teeth profiles suitably matching that of the drive teeth.

BRIEF DESCRIPTION OF THE DRAWINGS

In order that the invention may be well understood, some embodiments, given way of example only, will now be described with reference to the drawings, in which.

DETAILED DESCRIPTION

The drawings are not necessarily to scale, some features may be exaggerated to show details of particular components. Therefore specific structural and functional details disclosed herein are not to be interpreted as being limiting, but merely as a basis for the claims.

Figure 1:
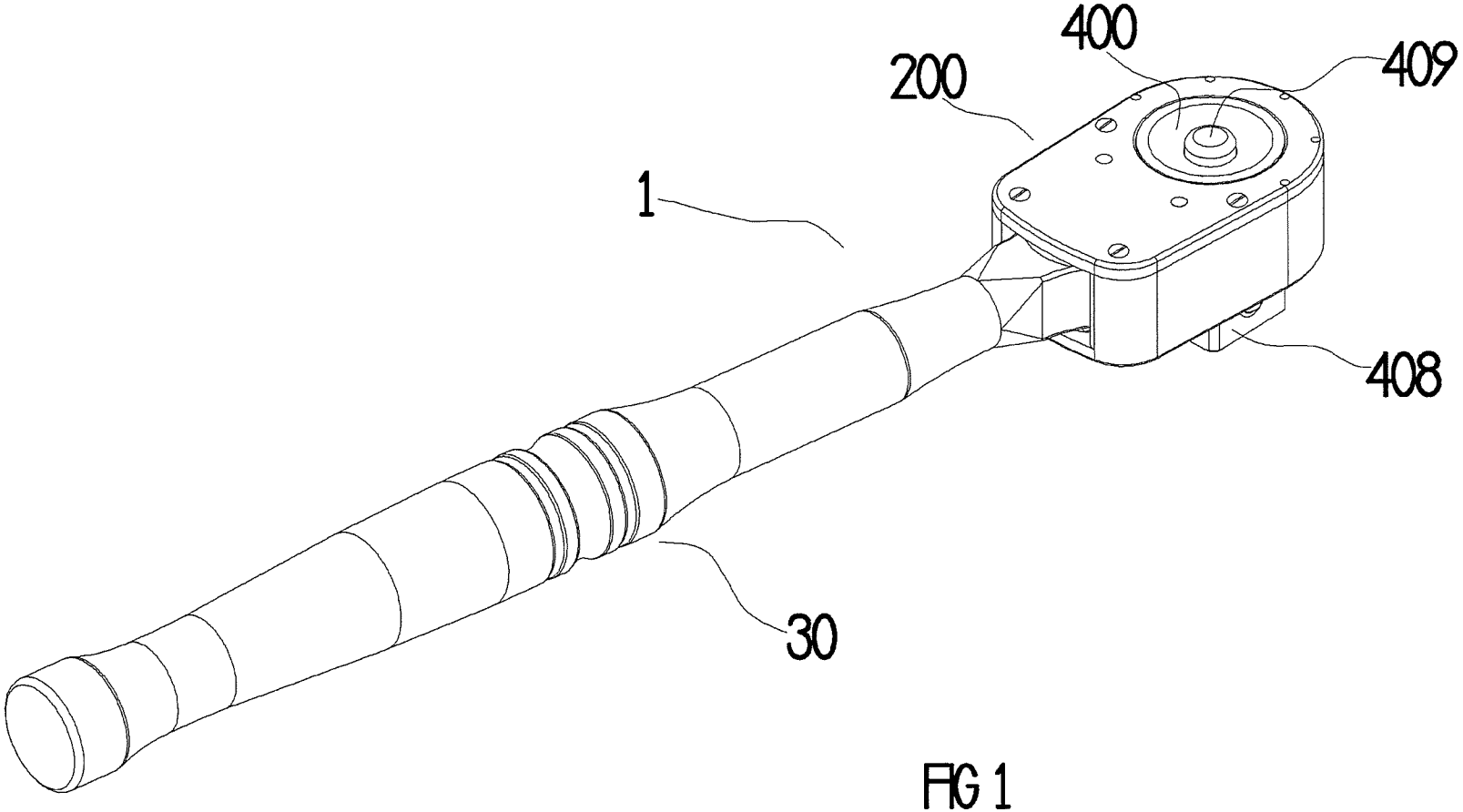
FIG. 1 is a perspective view of the small head ratchet wrench.

FIG. 1 illustrates an embodiment of a small head ratchet wrench 1, denoting an elongate handle portion 30 at one end and a wrench head 200 containing a drive element 400, a push button release 409 and drive spigot 408 at the other end.

Figure 2:
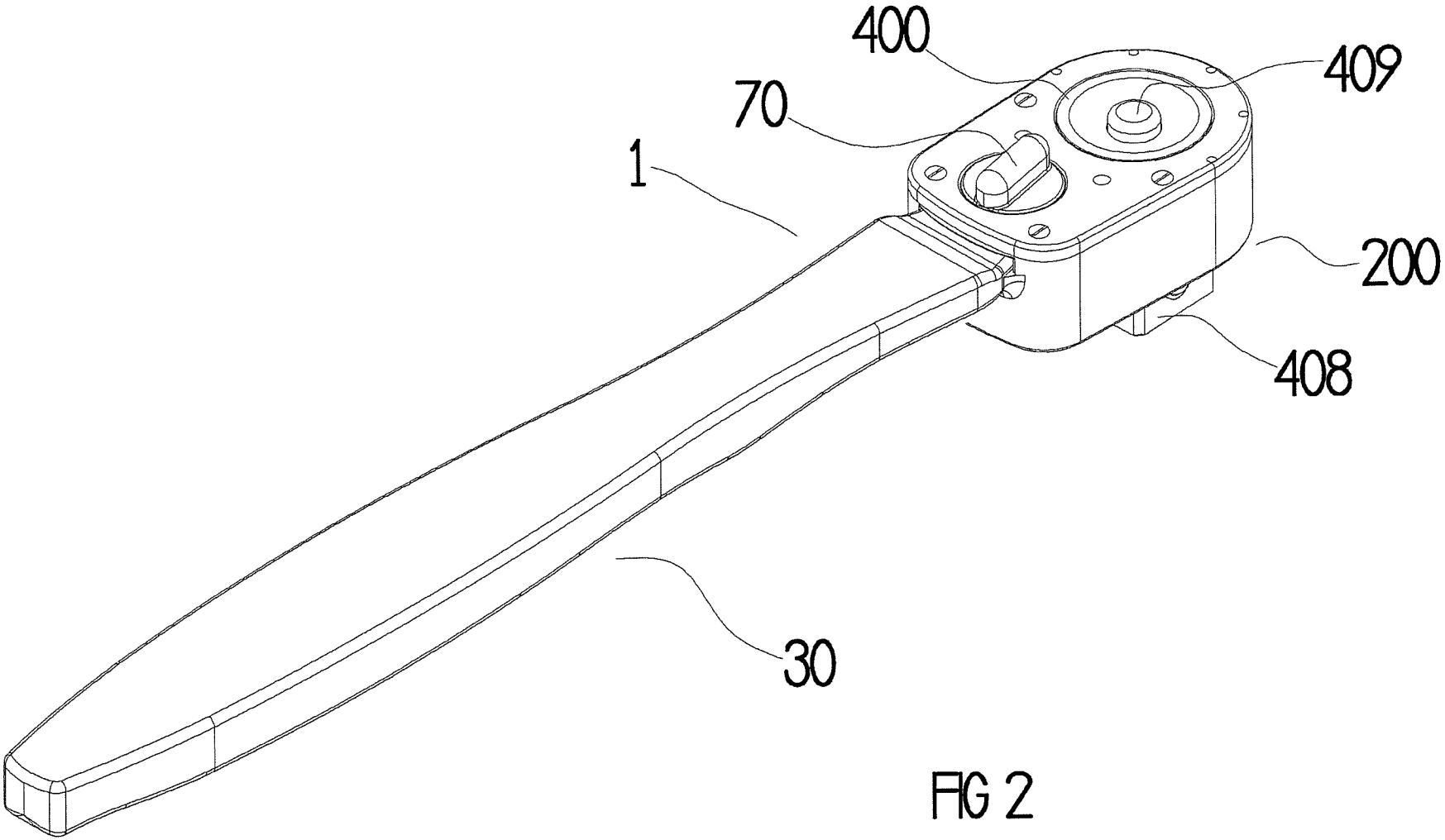
FIG. 2 is a perspective view of the small head ratchet wrench with a switch.

FIG. 2 illustrates a further embodiment of a said small head ratchet wrench 1 wherein the drive or reverse direction is effected by a switch 70, denoting the said handle portion 30 at one end and the said wrench head 200 with a said central drive element 400 with its push button release 409 and said spigot 408 at the other end.

Figure 3:
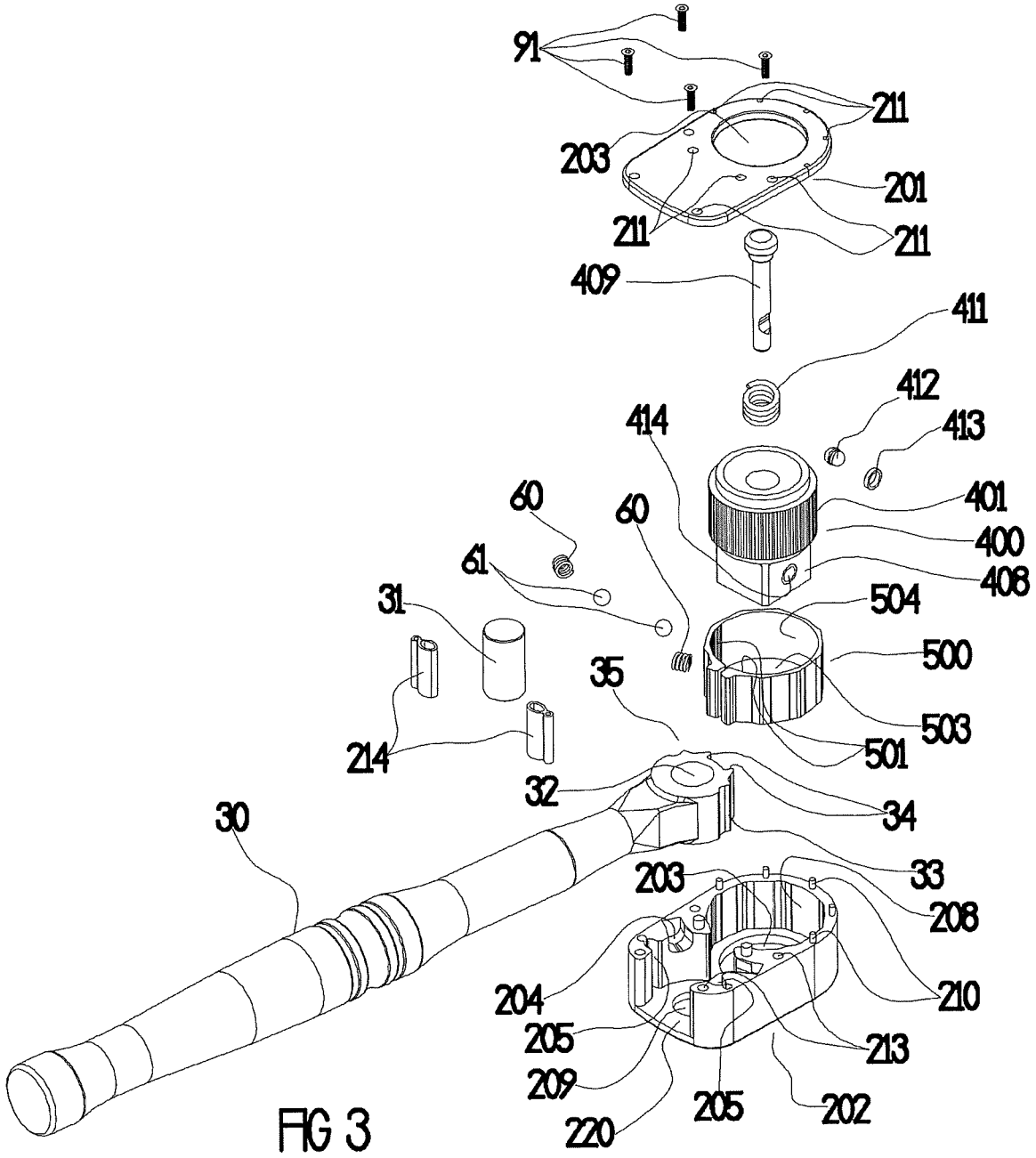
FIG. 3 is a perspective view of the small head ratchet wrench, the parts shown dismantled for display purposes.

FIG. 3 is a perspective view of the said small head ratchet wrench 1, the parts shown dismantled for display purposes. The top housing 201, bottom housing 202, housing aperture 203, spring and ball channel 204, dust seal channel 205, housing inner surface 208, pivot pin recess 209, housing closure protrusions 210, housing closure holes 211, housing screw holes 213, housing dust seals 214, housing opening 220 and retaining screws 91.

The said handle 30, handle pivot pin 31, handle pivot bore 32, biasing protrusion 33, actuator 34 and levered end 35. The said drive element 400, drive teeth 401, said drive spigot 408, said push button release 409, spring 411, spigot ball 412, ball retainer 413 and ball bore 414. Clutch ring 500, clutch toothed portion 501, clutch smooth portion 504 and clutch aperture 503. The springs 60, balls 61 and screw fixings 91 are further shown.

Figure 4:
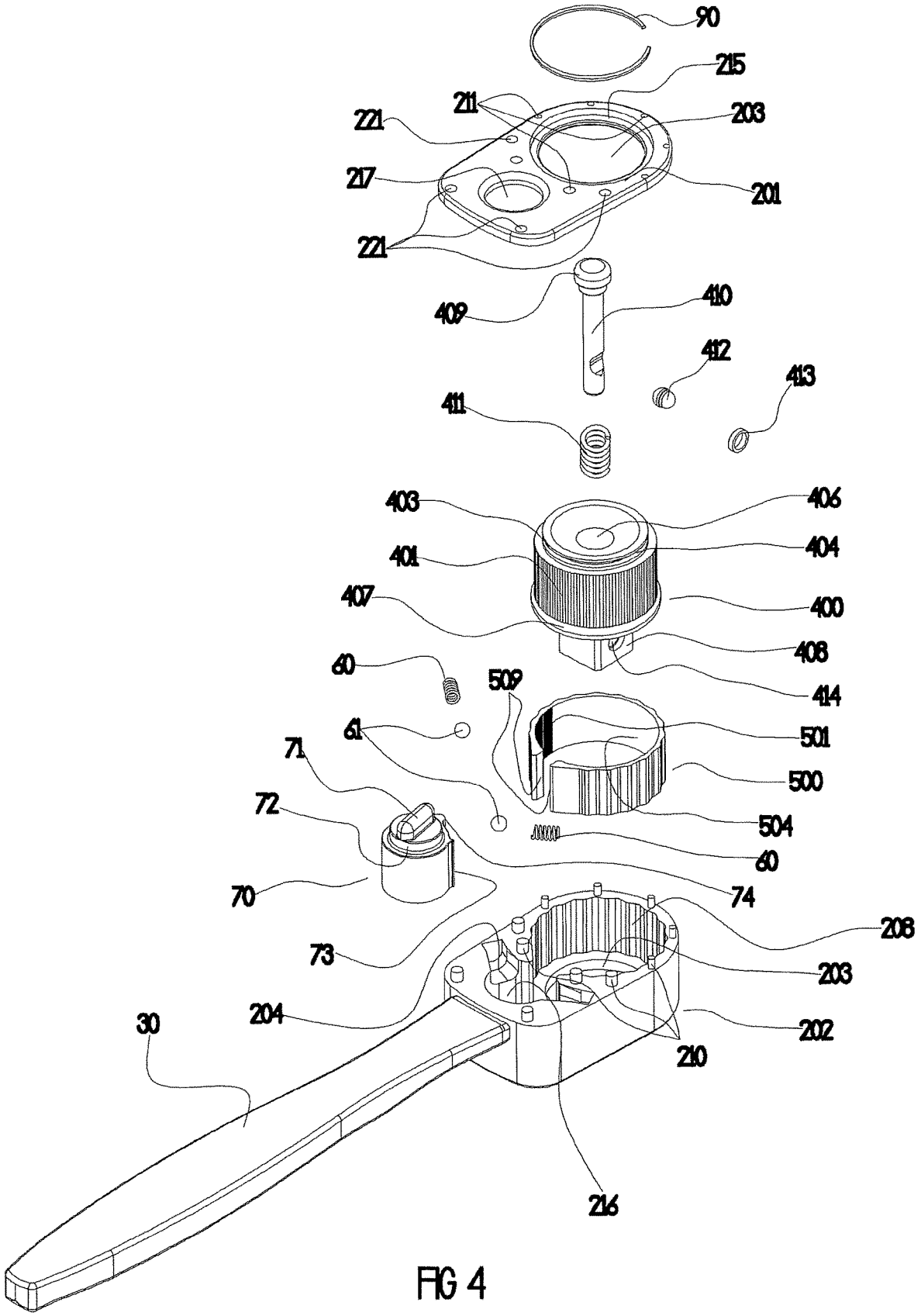
FIG. 4 is a perspective view of an alternately switched version of the small head ratchet wrench, the parts shown dismantled for display purposes.

FIG. 4 illustrates a further embodiment of a said small head ratchet wrench 1 wherein the required direction is effected by a said switch 70, the various parts are shown dismantled for display purposes. The said bottom housing 202 is directly attached to the said handle portion 30, the said top housing 201 being secured by a retaining clip 90 within the drive retaining clip channel 404, the said top housing 201 robustly secured to the said bottom housing 202 by said housing closure protrusions 210 held within the said housing closure holes 211. The said drive 400 having a said retaining flange 407, said teeth 401, drive axle 403, said spigot 408 said push button 409 with its shaft 410 and bush button bore 406, spigot spring 411, spigot ball 412, spigot ball retainer 413 and spigot ball bore 414. The said clutch ring 500, said toothed portion 501 and said smooth portion 504. The said top and bottom housing 201, 202 having a drive flange recess 215. The said top housing 201, having a further switch axle bore 217 and the said bottom housing 202 having a corresponding housing switch axle recess 216, and said housing aperture 203. The said switch 70 having switch axles 72, biasing protrusions 73, actuator 74 and finger grip 71. In use the said switch 70 is operated in the required direction, the said biasing protrusions 73 acting with the said springs and balls 60, 61 within their said spring and ball channel 204 to resiliently urge the said switch actuator 74 against the corresponding clutch actuation face 509.

Figures 5, 6:
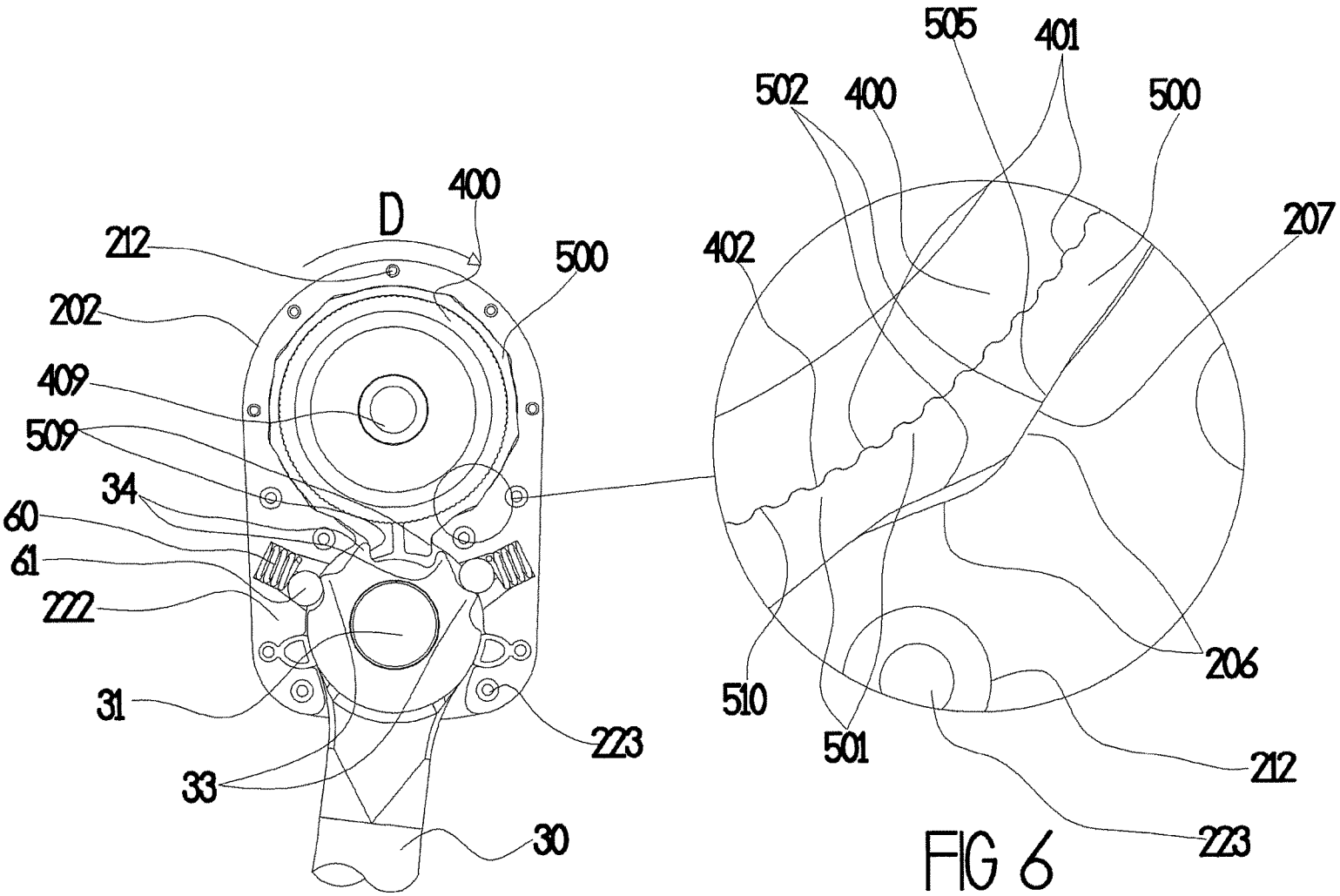
FIG. 5 is a top view of the small head ratchet wrench, the top housing is removed (not shown) for display purposes.
FIG. 6 is a close up view of the small head ratchet wrench clutch tail portion, drive teeth and housing ramps.

FIG. 5 illustrates the said small head ratchet wrench 1 operated in the drive direction D, the said top housing 201 (not shown) removed, showing the said bottom housing 202 inner face 222.

The said handle 30 swivelled in the required said drive direction D around the said pivot pin 31, the resilient action of the said spring and balls 60, 61 upon the said biasing protrusions 33 urging the said actuator 34 against the said clutch actuation face 509. The said drive element 400 is shown within the said clutch ring 500. The closure of the said top and bottom 201, 202 housings in this example is effected by the riveting of the illustrated rivet upstands 212 by the splaying of the rivet upstand centre hole 223.

FIG. 6 is a close up view of the said low profile ratchet 1, the said clutch toothed portion 501 said teeth 510 engaged within the said corresponding drive teeth 401, the said drive teeth 401 having flat tops 402.

The engagement of the clutch ring 500 with the drive element 400 is enhanced by the inward projection of the said clutch ring 500 as the clutch transmission ramps 502 and abutment angles 505 abutting the housing ramps 206 and contact angles 207 are driven upwards against one another as the said ratchet 1 is operated in the drive direction D. The said centre hole 223 of the said rivet upstand 212 is also shown.

Figure 7:
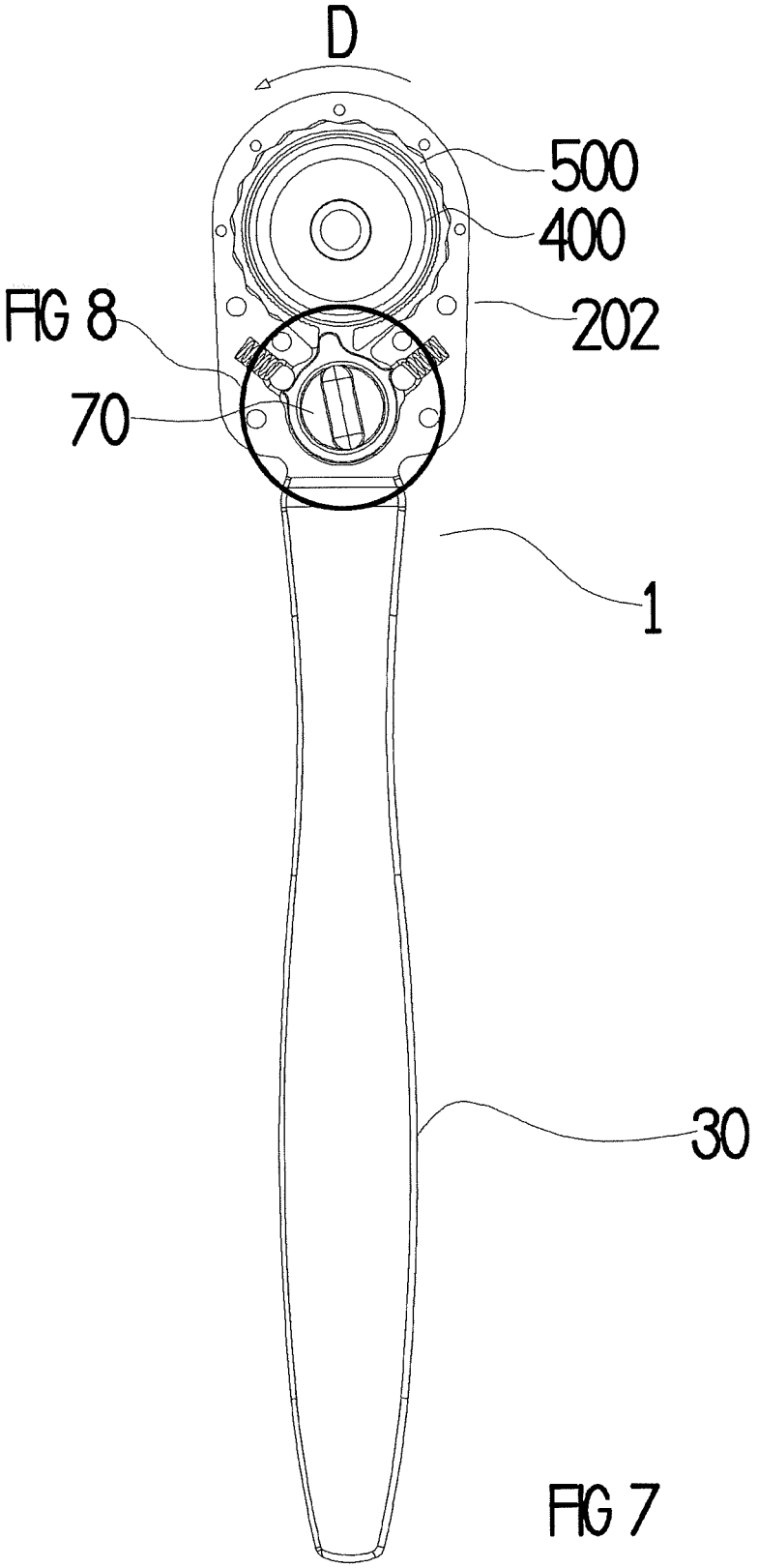
FIG. 7 is a top view of a switched version of the small head ratchet wrench, the top housing is removed (not shown) for display purpose.

FIG. 7 is a top view of a said switch 70 version of the said small head ratchet wrench 1, the said top housing 201 (not shown) removed, illustrating the said drive 400 and said clutch ring 500. The said bottom housing 202 is directly attached to the said handle portion 30.

Figure 8:
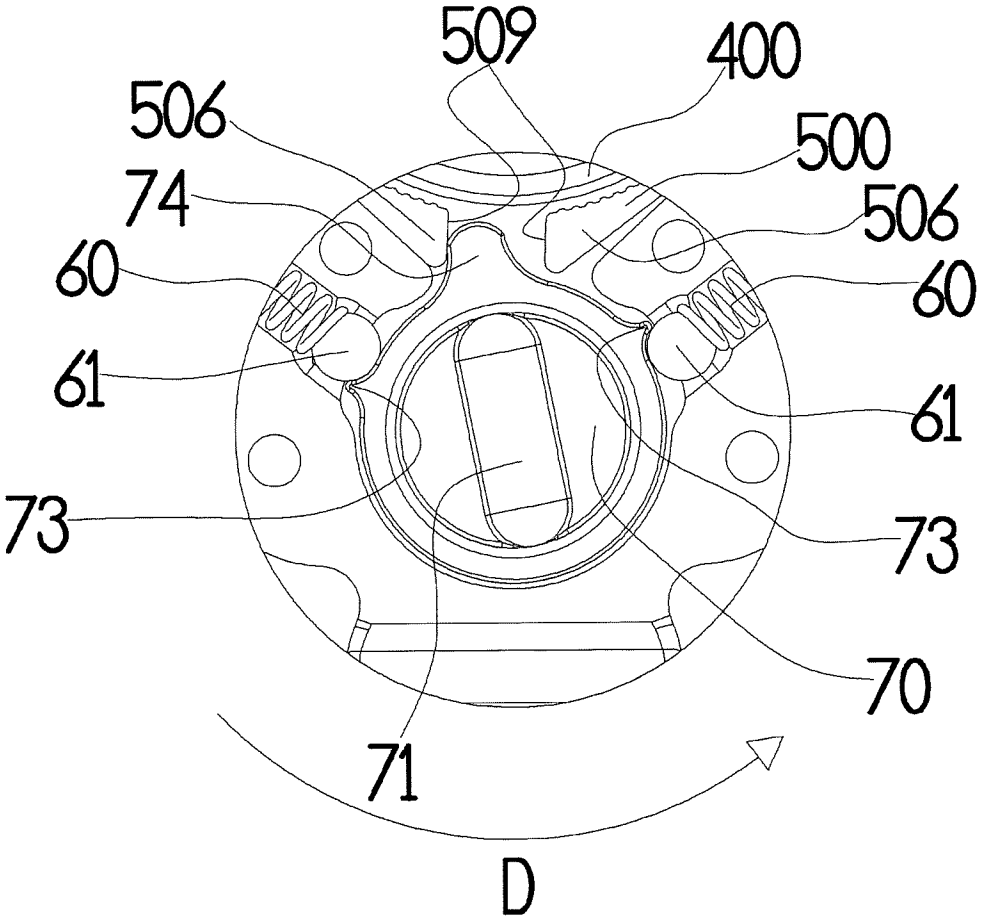
FIG. 8 is a close up view of a switched version of the small head ratchet wrench denoting the switch with biasing protrusions and its interaction with the clutch actuation faces.

FIG. 8 is a close up view of the said switch 70 version of the said small head ratchet wrench 1 denoting the said switch 70 actuated in the required direction by the said switch finger grip 71, positioning the said biasing protrusions 73 causing the said actuators 74 interaction with the said clutch actuation faces 509. The said spring and balls 60, 61 providing the said biasing of the said clutch ring 500 in the required Drive direction D. The said biasing springs 60 resilient force being transmitted via the said switch biasing protrusion 73 then said actuator 74 to the said clutch actuation face 509 within the tail portion 506.

Figure 9:
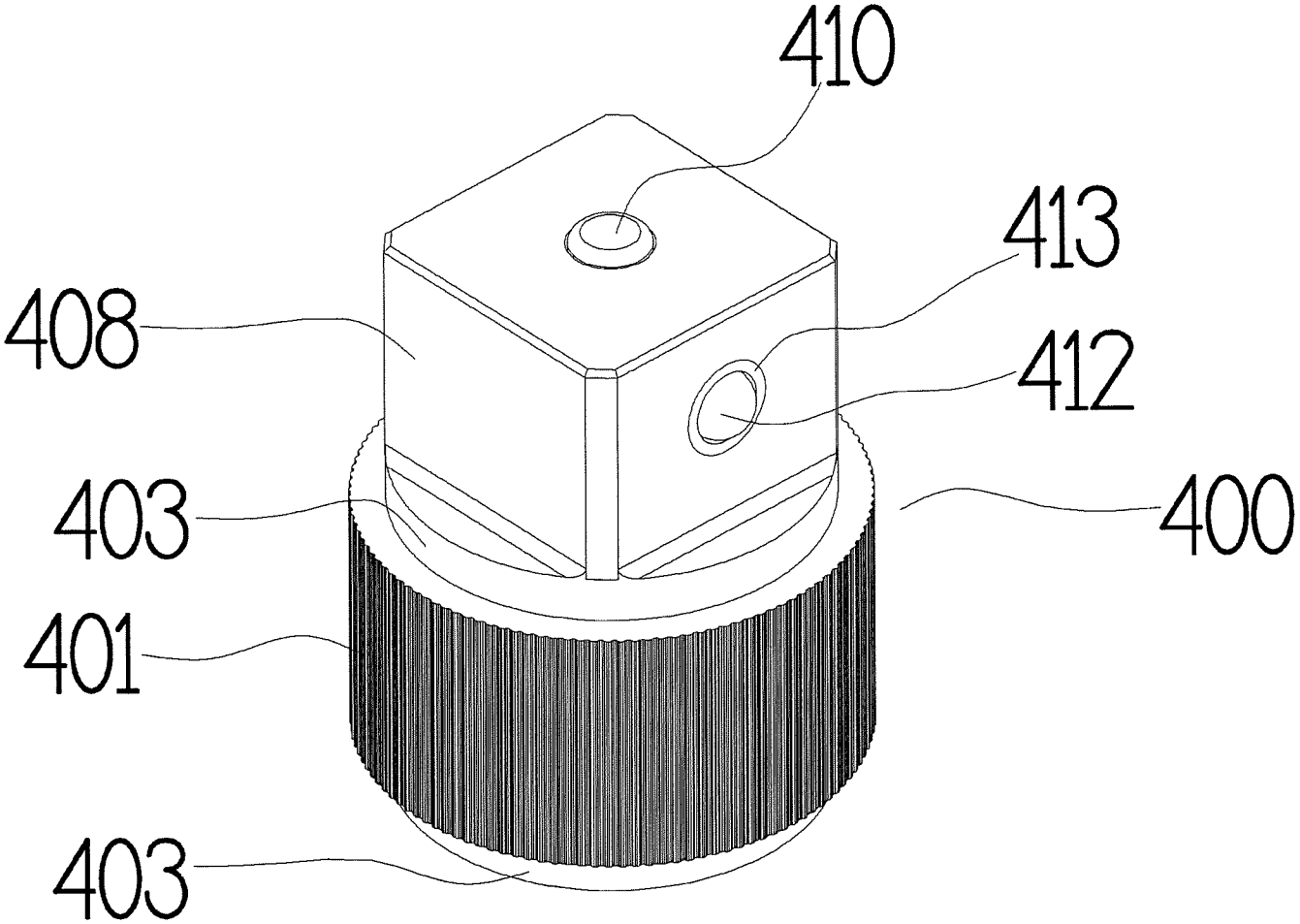
FIG. 9 is a perspective view of the small head ratchet wrench drive element.

FIG. 9 is the said drive element 400 showing the said drive teeth 401, drive axles 403, said spigot 408, said push button shaft 410, spigot ball 412 and spigot ball retainer 413.

Figure 10:
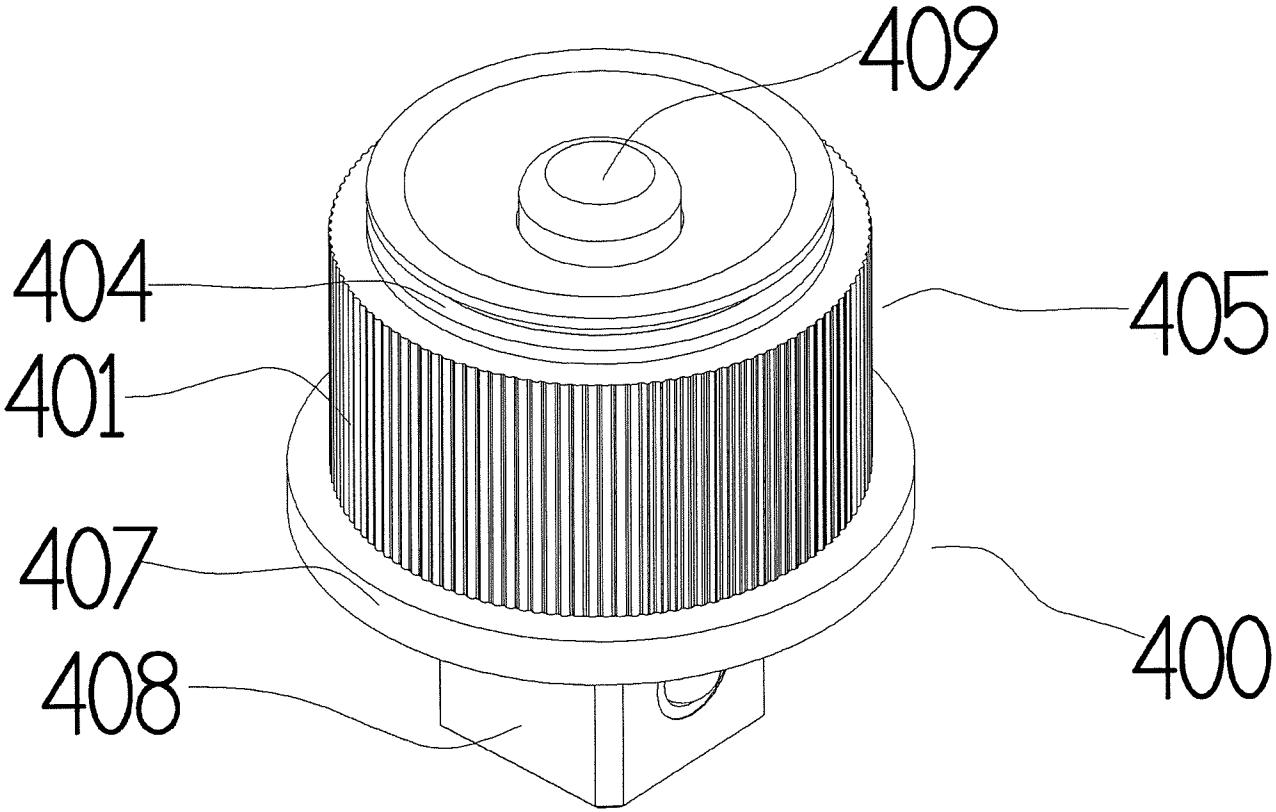
FIG. 10 is a perspective view of the small head ratchet wrench drive element complete with retaining flange.

FIG. 10 is a further iteration of the said drive element 400 complete with a retaining flange 407, comprising said drive teeth 401, said drive axle 403, said retaining clip channel 404, outer surface 405, said spigot 408 and push button 409.

Figure 11:
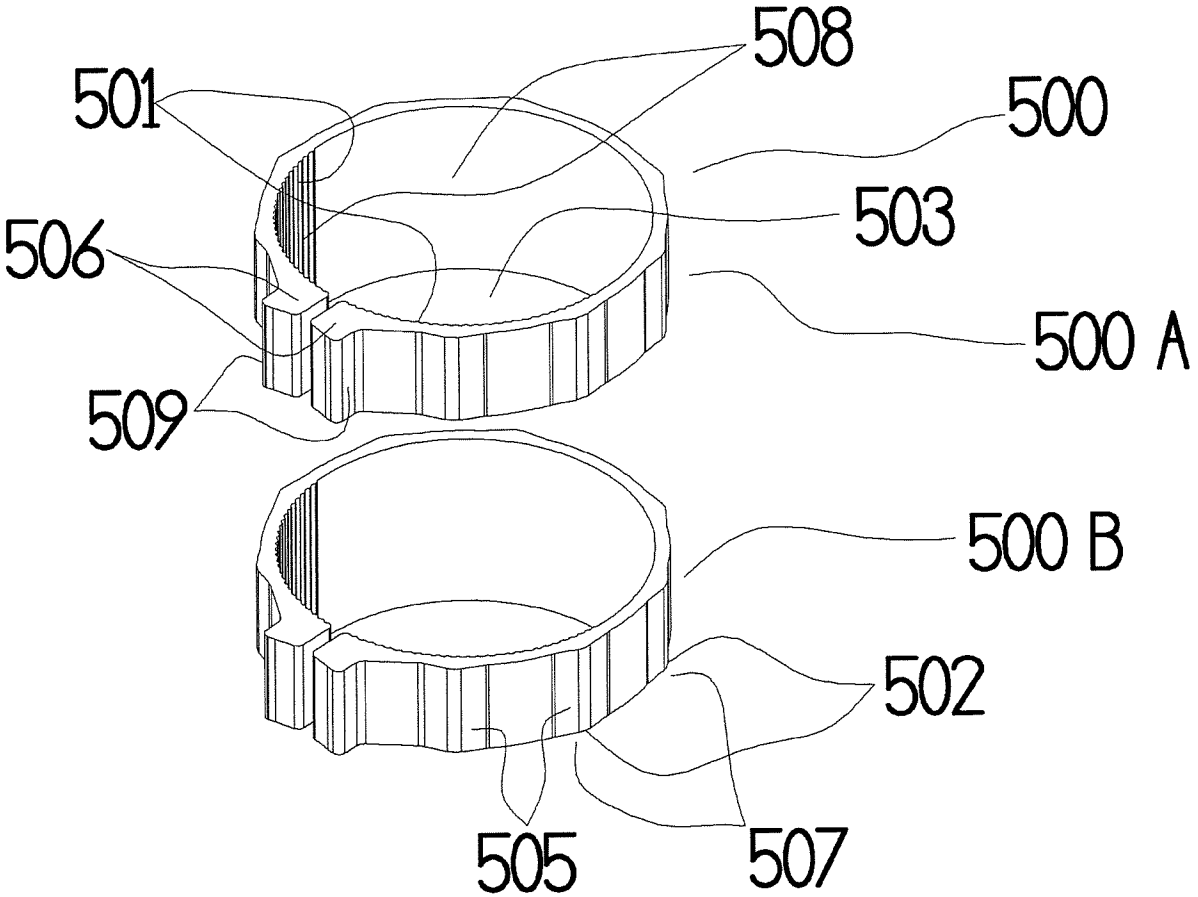
FIG. 11 is a perspective view of the partially toothed small head ratchet wrench clutch ring, the clutch ring shown constructed in layers.

FIG. 11, is the said clutch ring 500 comprising, a said toothed portion 501, said transmission ramps 502, said aperture 503, said smooth portion 504, said abutment angle 505, said tail portion 506, said outer surface 507, inner surface 508 and said actuation faces 509, the said clutch ring 500 separated into several layers 500*a*, 500*b* illustrated.

Figure 12:
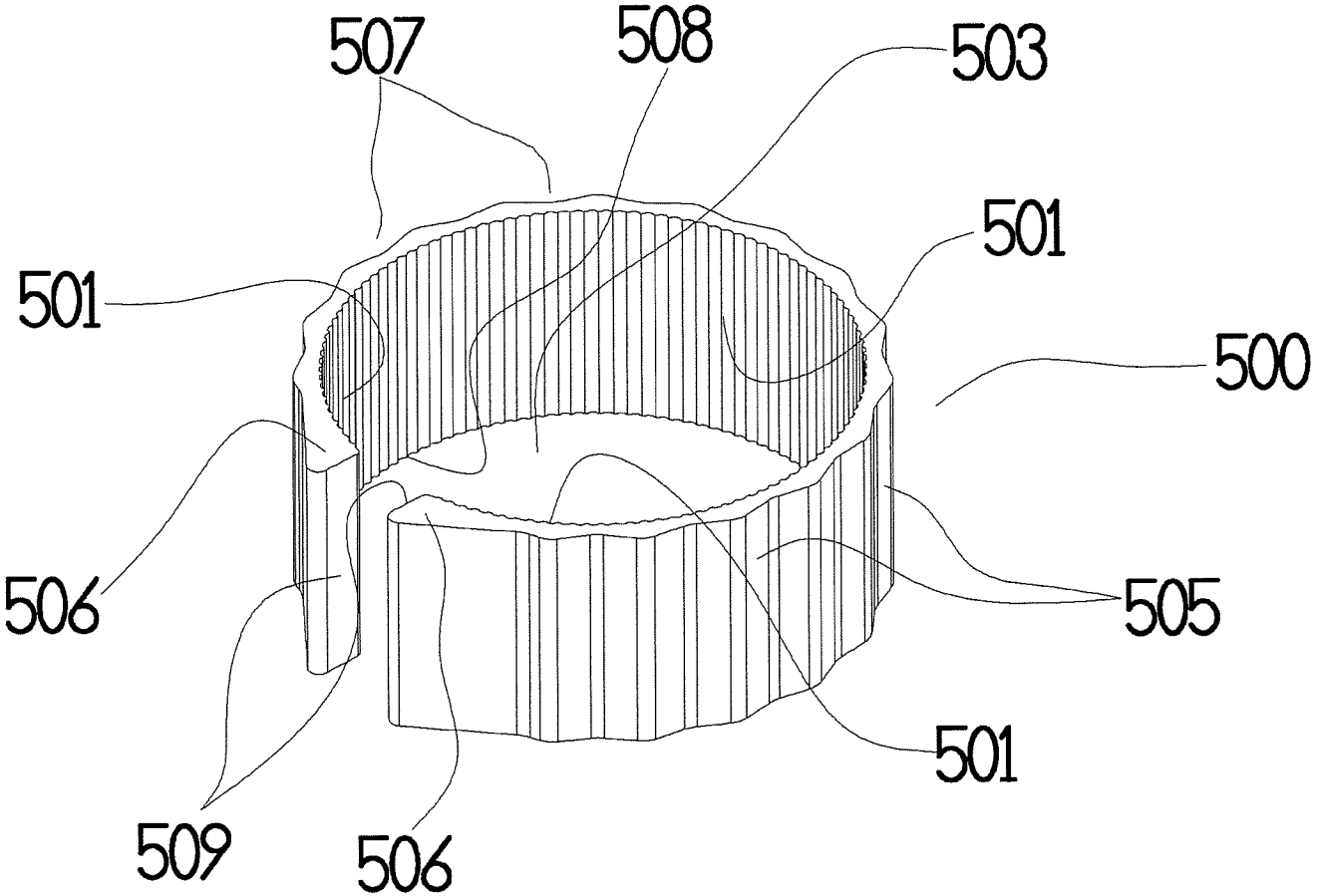
FIG. 12 is a perspective view of a fully toothed small head ratchet wrench clutch ring.

FIG. 12, is a further iteration of the said clutch ring 500 whereas the said inner surface 508 said toothed portion 501 is complete, also illustrating the said transmission ramps 502, said aperture 503, said abutment angle 505, said tail portion 506, said outer surface 507 and said actuation faces 509.

Figure 13:
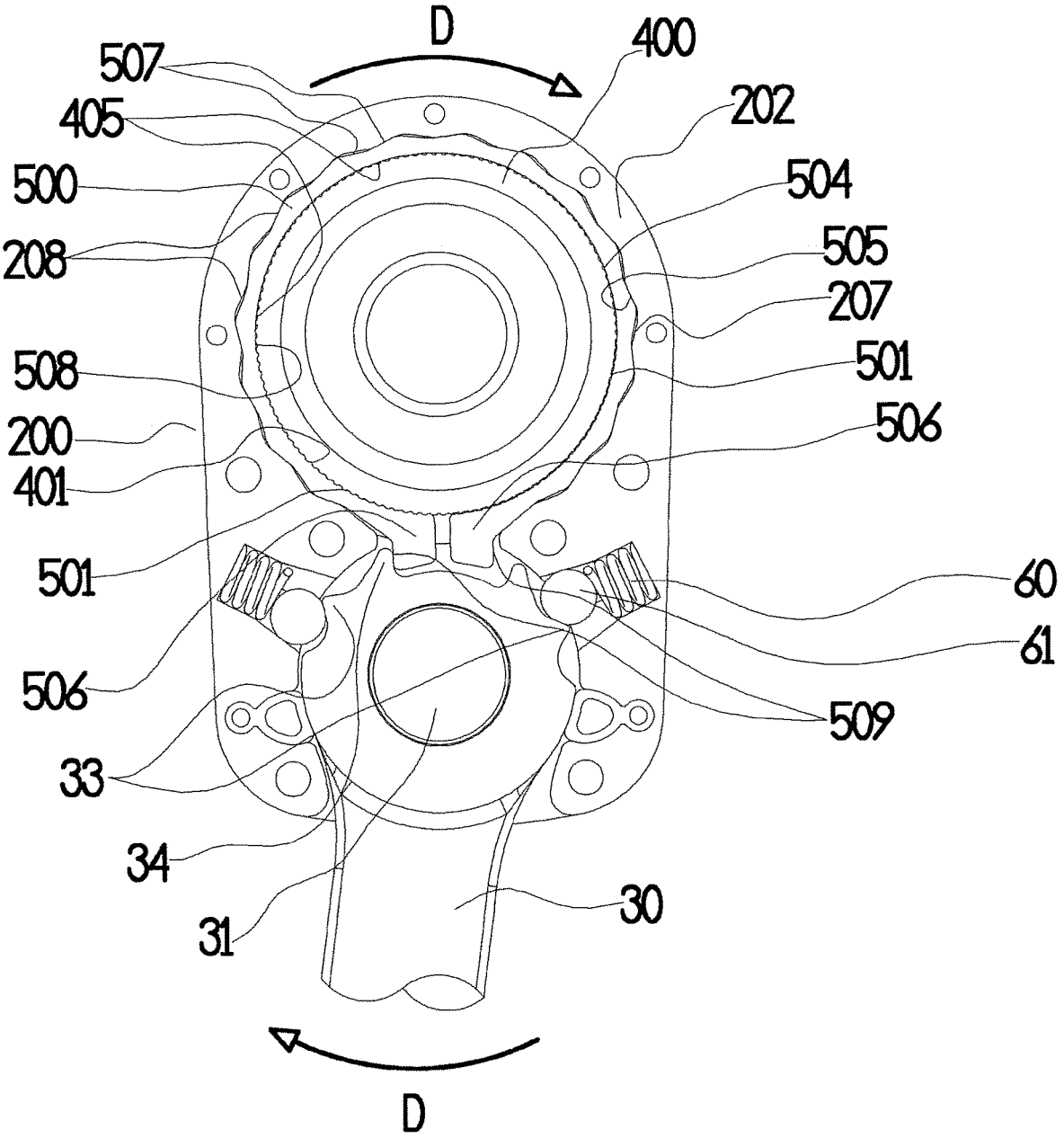
FIG. 13 is a top view of the wrench head of the small head ratchet wrench, the top housing is removed (not shown) for display purposes.

FIG. 13 is a top view of the said small head ratchet wrench 1 said wrench head 200, the said top housing 201 removed (not shown). The said handle 30 and said wrench head 200 rotating as required around the said handle pivot pin 31, operated in the said Drive direction D, the said springs and balls 60, 61 resiliently acting on the said handle protrusions 33 causing the said actuator 34 to resiliently act against the said clutch actuation face 509 thereby urging the said clutch toothed portion 501 in best practice affixed the said clutch tail portion 506 to engage the said corresponding drive element 400 said teeth 401. This initial grip further allows the said clutch ramp abutment angle 505 to act upon the said housing ramps contact angle 207 forcefully constricting the said clutch ring 500 said toothed 501 and smooth portions 504 upon the said drive element 400. The compression and locking force increasing according to the torque applied to the said handle portion 30 to the said clutch first end 506.

It can be observed from the illustration that during use in the said drive direction D that the said housing inner surface 208 is in equal force contact with most of the said clutch outer surface 507 and the said clutch inner surface 508 is in equal force contact upon the majority of the drive outer surface 405 thereby substantially distributing the inward and outward forces evident within the said wrench head 200 within the circumference of the aforementioned parts. The outcome of this construction is a pseudo laminate construction which is far stronger than the prior art separate component constructions. The said present invention 1 is able to be in one example to be reduced in head circumference compared to any previous commercially available device, yet still exceed all relevant torque specifications.

Figure 14:
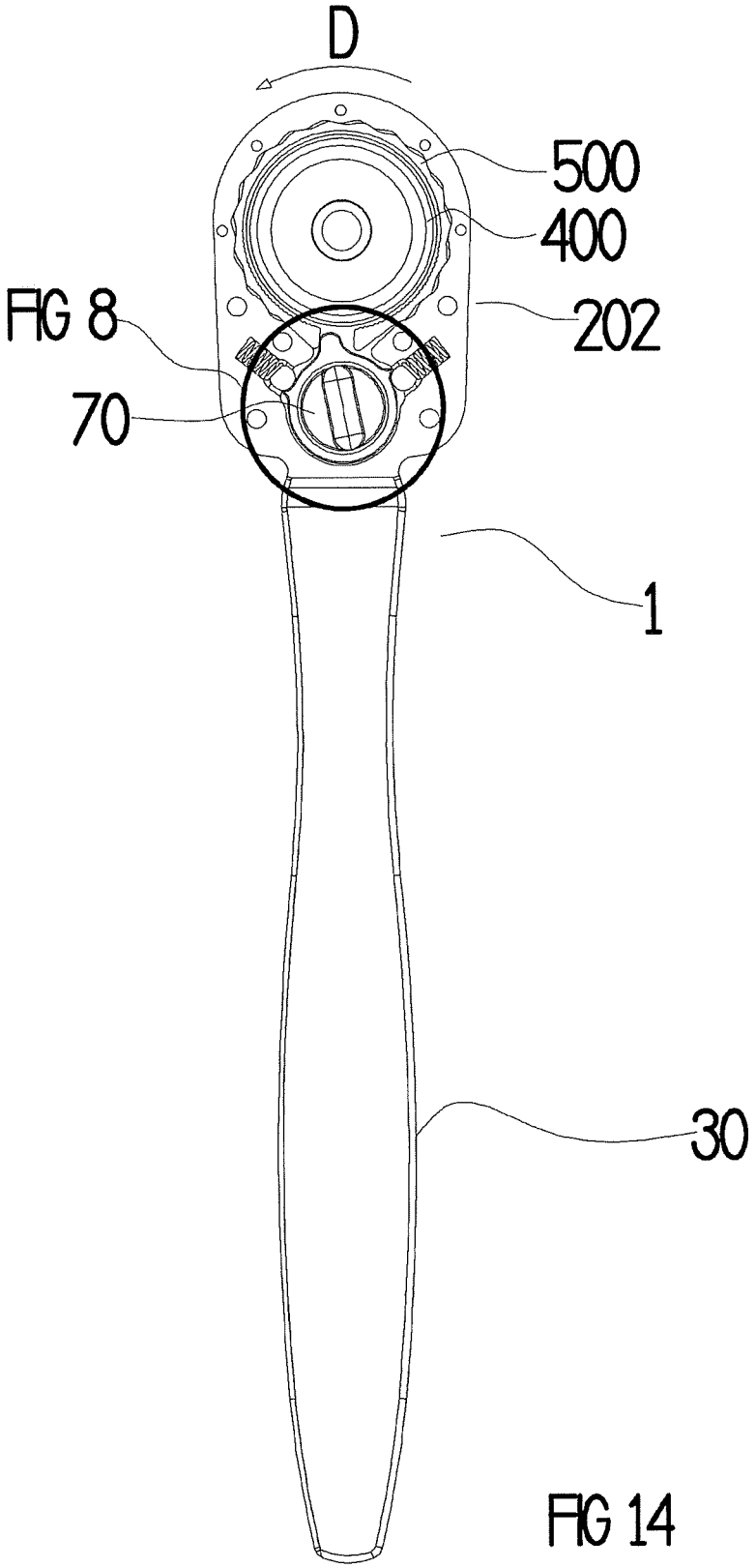
FIG. 14 is a top view of an alternately actuated version of the small head ratchet wrench, the top housing is removed (not shown) for display purposes.
Figure 15:
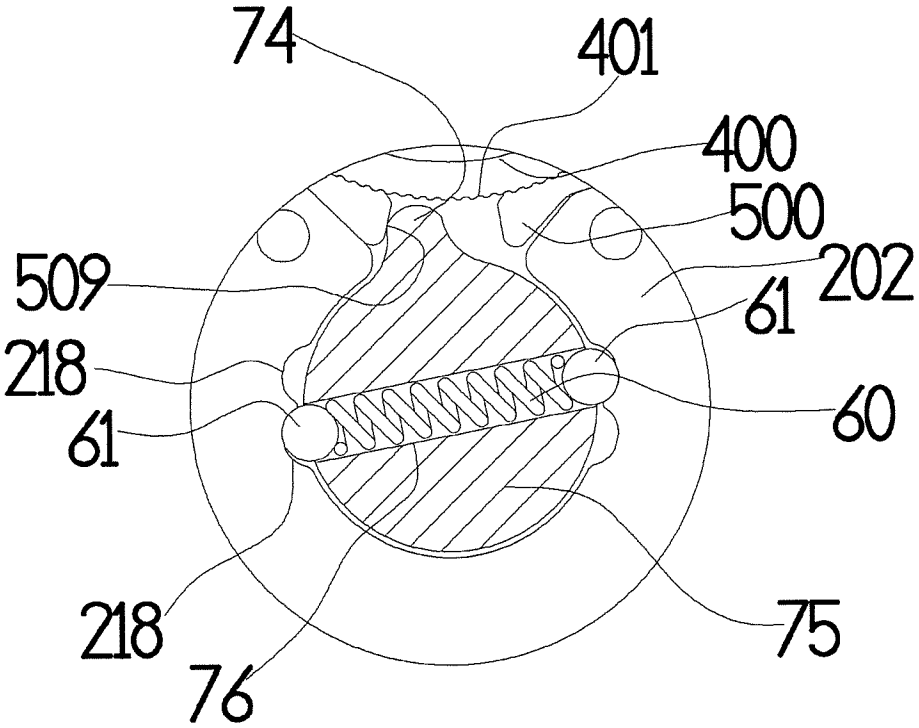
FIG. 15 is a close up view of an alternate switched version of the small head ratchet wrench denoting the housing incorporating biasing protrusions, the spring and balls within the switch spring bore and its interaction with the clutch actuation face, the switch is shown in section for display purposes.

FIGS. 14, 15 (in section) shows an alternate switched 75 version of the said small head ratchet wrench 1, the said top housing 201 removed (not shown), the said bottom housing 202 affixed the said handle portion 30.

The said alternate switch 75 having a spring bore 76 retaining the said spring 60 and balls 61. The said balls 61 acting against the alternate biasing profile 218 in order to impose the required resilient pressure in the desired drive direction D from the said switch actuator 74 to the said clutch actuation face 509 in order to resiliently initially engage the said clutch ring 500 upon the said drive element 400 teeth 401.

Figure 16:
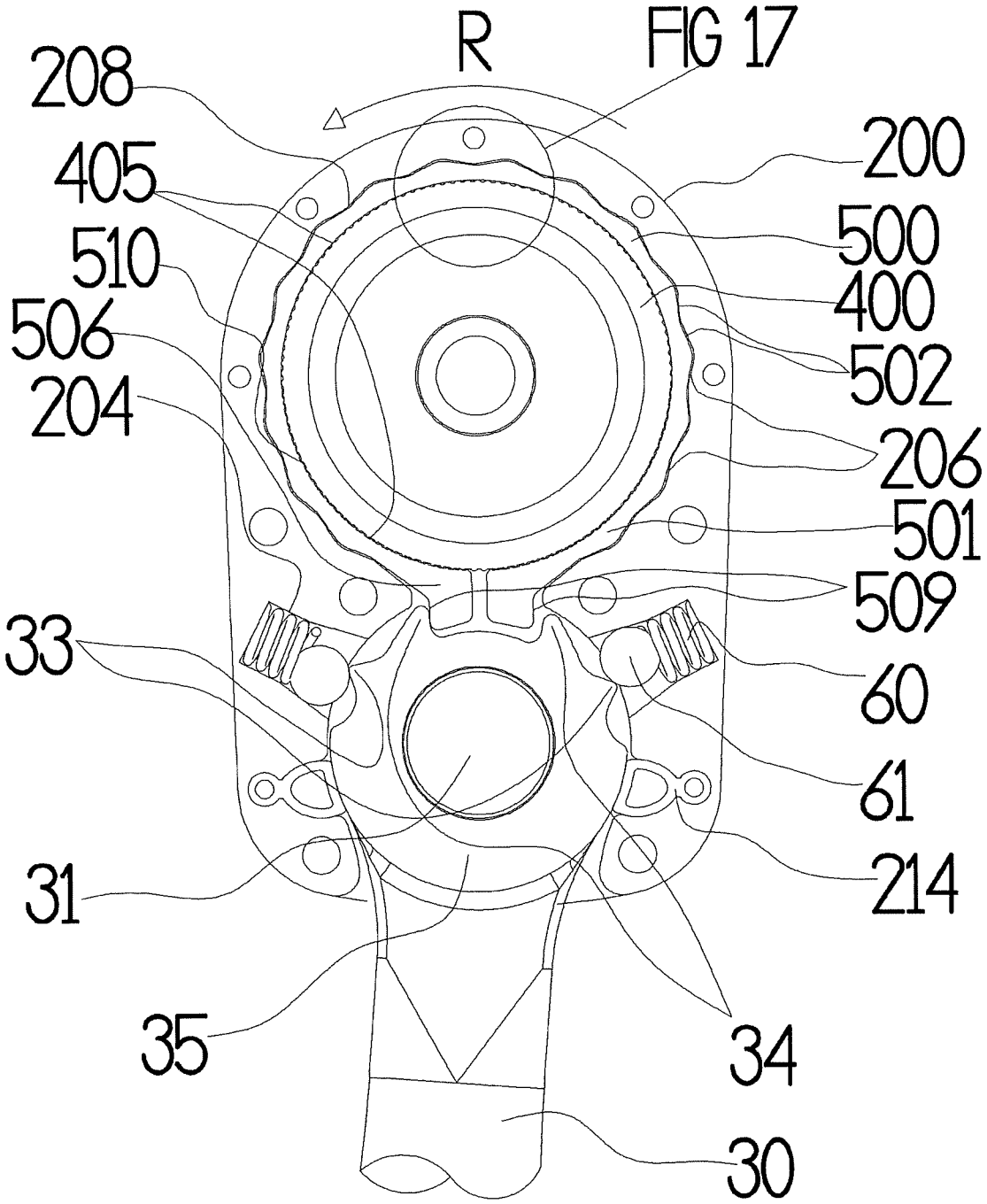
FIG. 16 is a top view of an alternately actuated version of the small head ratchet wrench, the top housing is removed (not shown) for display purposes. The handle is biased in the reverse direction.
Figure 17:
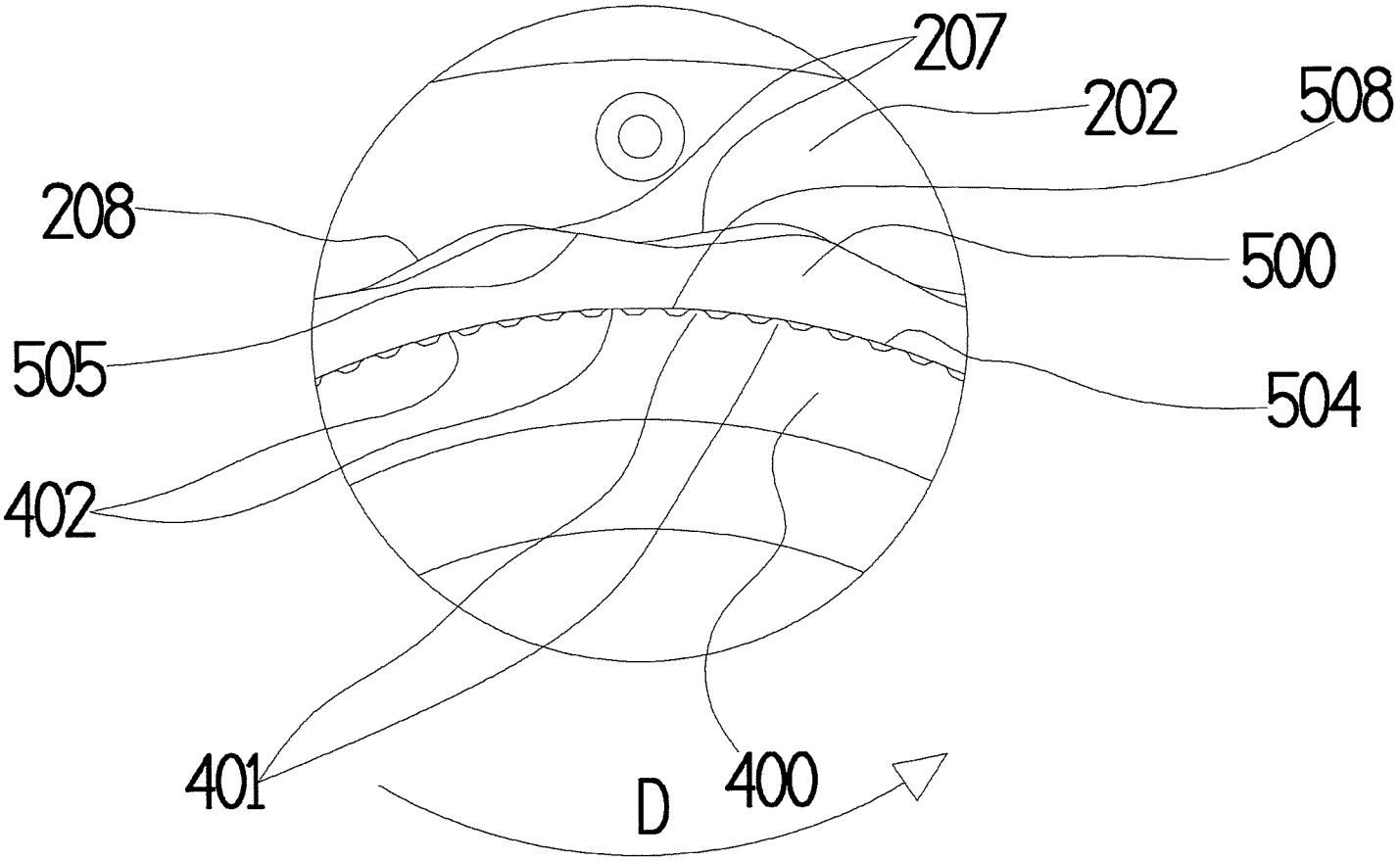
FIG. 17 is a top close up view of the interior of the small head ratchet wrench, depicting the interaction between the clutch smooth portion and the drive teeth. The housing is biased in a drive direction with the housing ramps acting upon the clutch ramps clamping the said clutch smooth portion upon the flat tops of the drive teeth.

FIGS. 16 and 17 show a further version of the said small head ratchet wrench 1, the said top housing 201 removed (not shown), wherein the said clutch ring 500 has its said actuation faces 509 on the said opposite first ends 506, meaning that the said clutch ring 500 is pulled around the said housing inner surface 208 in the first instance, not pushed as previously shown. The said handle levered end 35 actuators 34 being further recessed. The said handle 30 and said wrench head 200 rotating as required around the said handle pivot pin 31, in this instance operated in the reverse or reposition direction R, the said handle protrusions 33 causing the said springs and balls 60,61 to be resiliently propelled back up the said spring and ball channel 204 thereby causing the said actuator 34 to reduce or release its pressure against the said clutch actuation face 509, the said clutch transmission ramps 502 no longer abutting the corresponding said housing ramps 206 thereby disengaging the clutch teeth 510 from the drive outer surface 405 and allowing the said wrench head 200 and said clutch portion 500 to rotate relative to the said drive element 400. FIG. 17 illustrates a close up of the said low profile ratchet 1, comprising a ratchet mechanism wherein in order to achieve utmost said drive tooth 401 contact with the said inner sidewall of the clutch 508, it is desirable that the innermost circumferential profile of both the said toothed section 501, and said smooth section 504 of the said clutch sidewall 508 are identical. To that end, the said clutch's inner smooth section profile 504 is substantially the same as the inner height of the teeth 510 of the said toothed section 501, a further aid being the tops of the said outer toothed wall 401 of the said drive portion 405 are preferably radiused or near flat topped 402, the said "flat top" 402 being substantially the same circumferential profile as the said inner sidewall 508 of the said clutch's smooth section 504.

Figure 18:
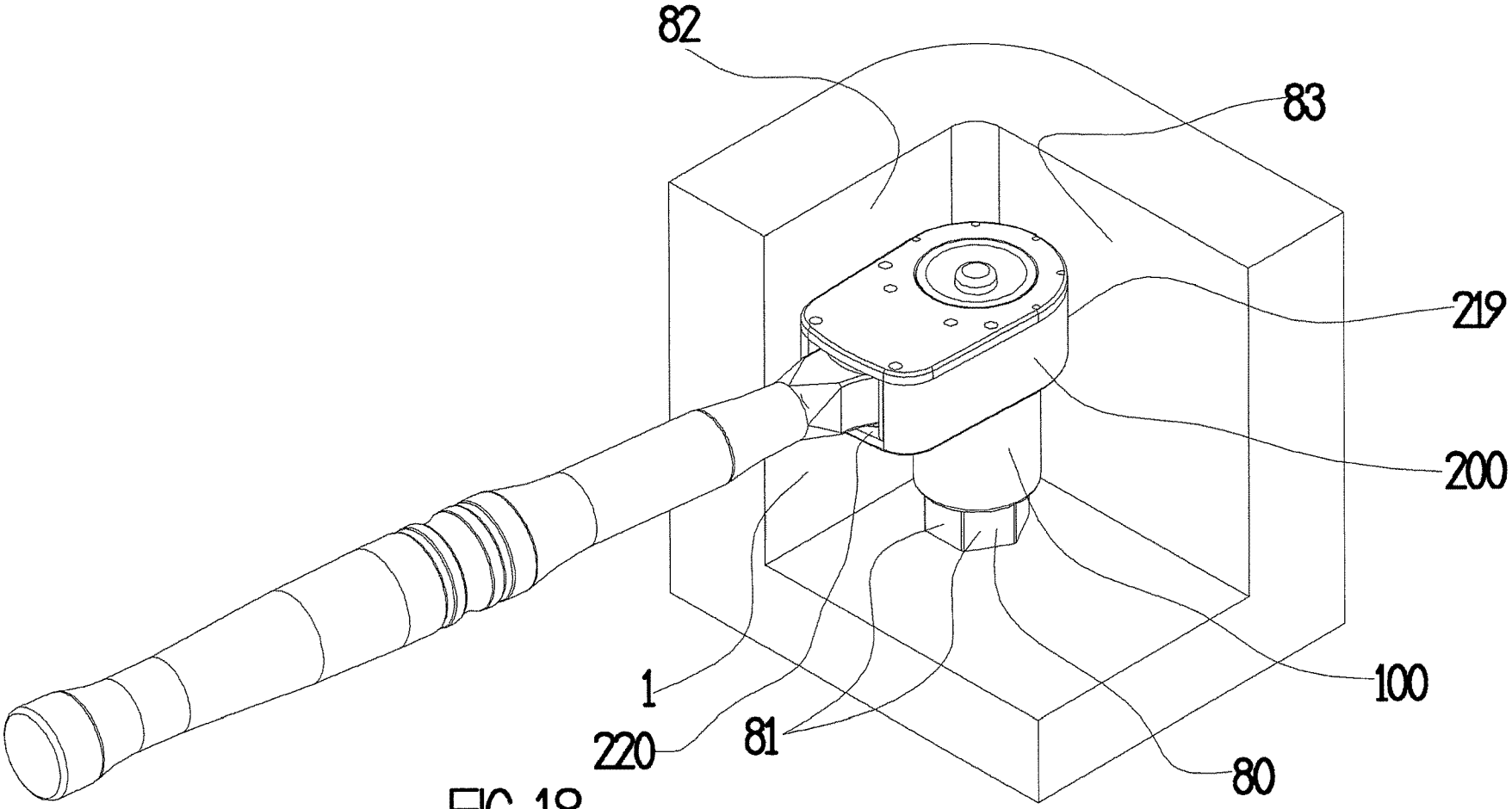
FIG. 18 is a perspective view of the small head ratchet wrench. A socket is shown engaged upon the ratchet mechanism spigot, the ratchet being used in close vicinity of obstructions.

FIG. 18 illustrates the small head ratchet wrench 11 with a said socket 100 engaged upon the drive spigot 408 (not visible). The said socket 100 further engaged upon an appropriately sized fastener 80 drive surfaces 81. The said ratchet 1, said socket 100 shown for illustration purposes operated in a gap between close obstruction (a) 82 and obstruction (b) 83 and the housing outer surface 219. The housing opening 220 is further shown.

Figure 19:
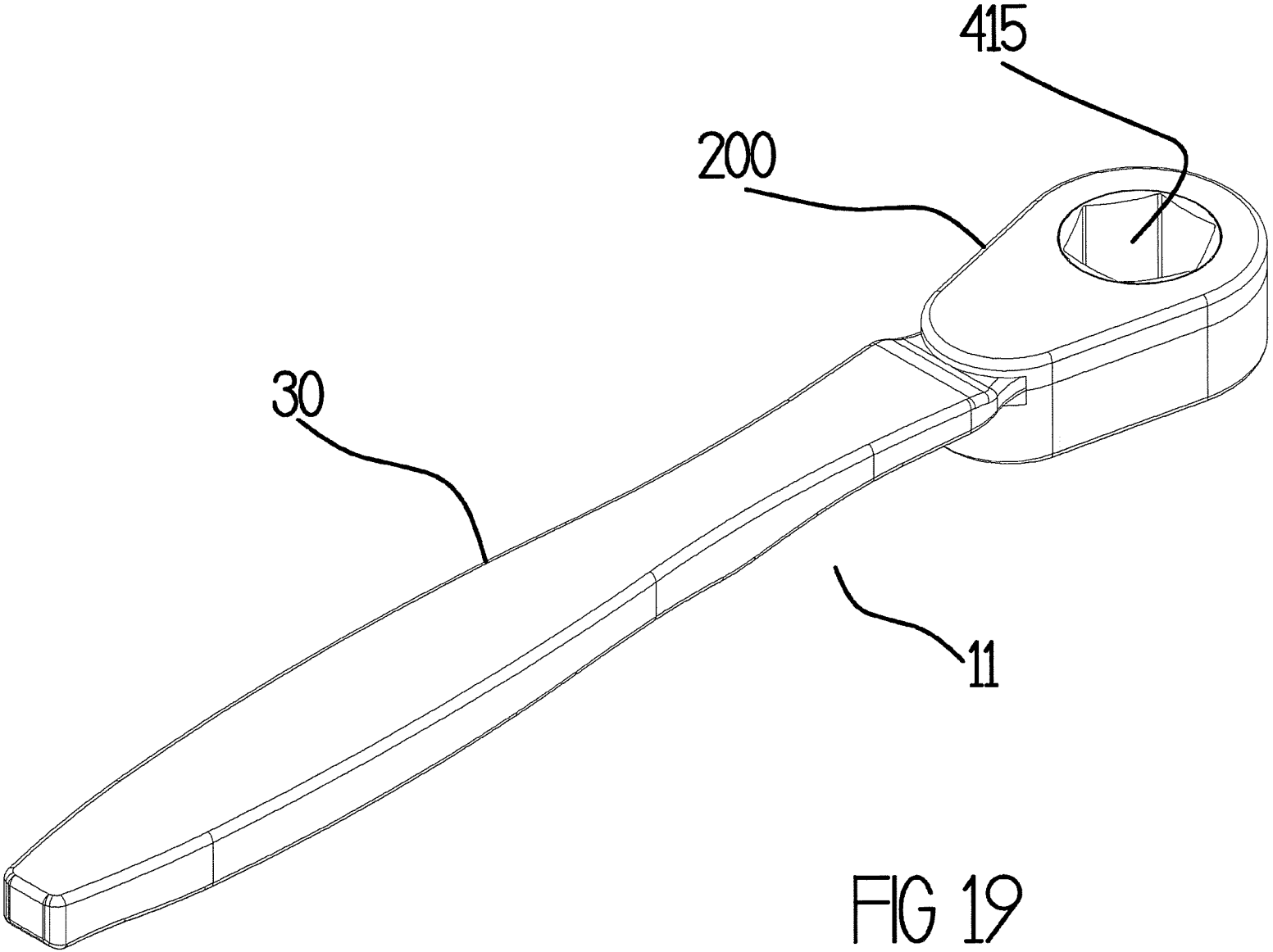
FIG. 19 is a perspective view of the small head ratchet wrench in which a drive element has fastener engaging faces.

FIG. 19 shows the said small head ratchet wrench 11 whereas the said housing 200, said handle 30 are used in conjunction with a drive fastener engaging profile 415 to form a ratcheting wrench 11.

Figure 20:
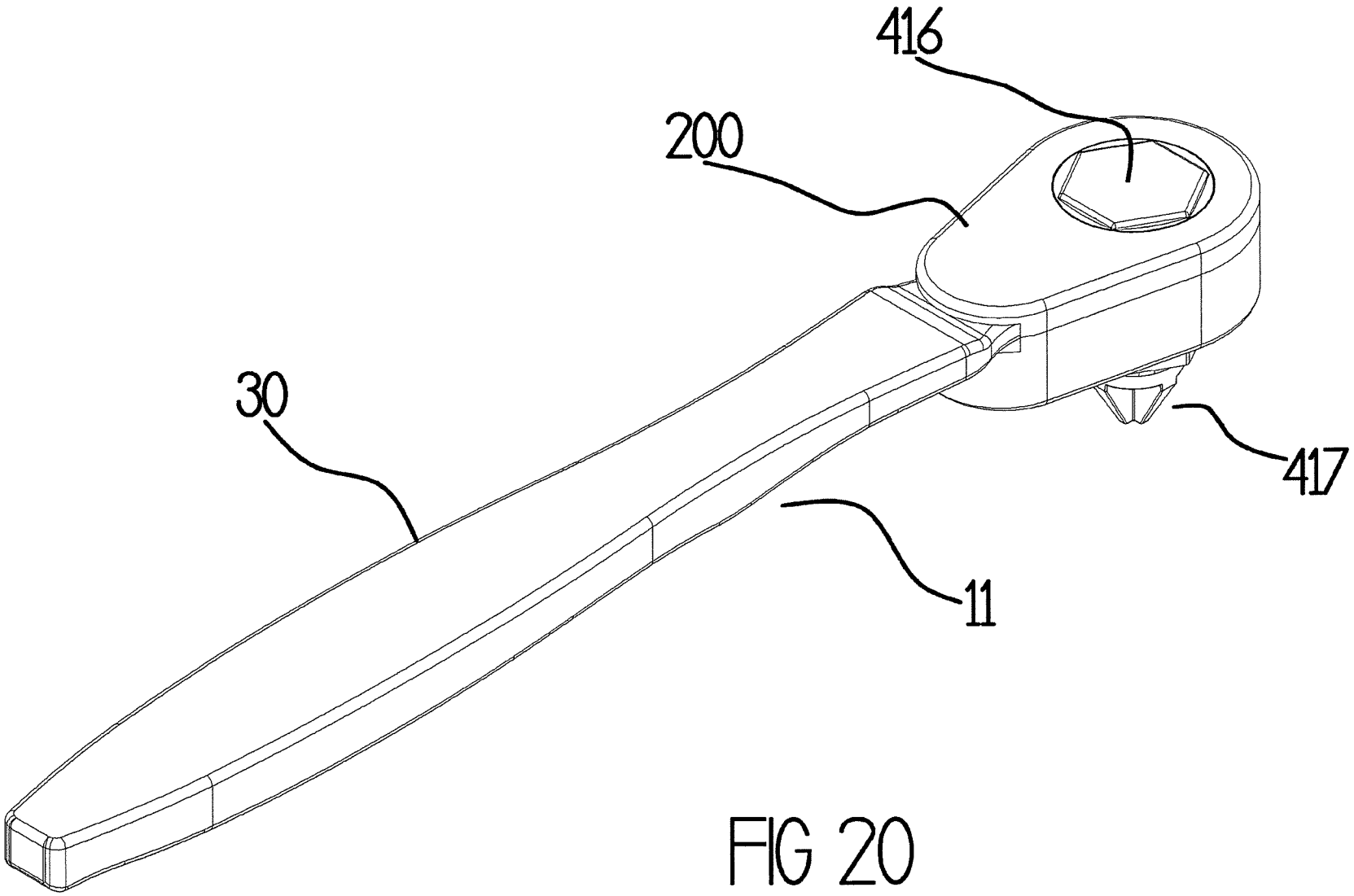
FIG. 20 is a perspective view of a small head ratchet wrench fitted with a drive bit.

FIG. 20 shows the said small head ratchet wrench 1 whereas the said housing 200, said handle 30 are used in conjunction with a drive bit holder profile 416 to form a said ratcheting wrench 11 of a size capable of utilizing corresponding hexagonal screwdriver drive bits etc. 417.

FIGS. 1 to 20 illustrate various examples of the said small head ratchet wrench 1 wherein the said levered end 35 of the said handle portion 30 has, in one iteration, said biasing protrusions 33 for interaction with at least one said spring 60 and ball detents 61, the said sprung detent 60, 61 acting to provide a direction bias and the initial grip in the required said drive direction D of the said clutch ring 500 upon the said central drive 400. In the said devices 1 rest position, the partially compressed said springs 60 transmit their resilient force via the said detent balls 61 and said handle levered end 35 said actuator 34 to the said clutch ring 500 in order to provide the necessary initial clamping of the said clutch ring 500 and to obviate any slack or play inherent in normal ratchets.

The clutch portion 500 having a generally smooth inner surface 504 with in best practice a said toothed 501 first end 506 and a said outer surface 507 with said ramp like undulations 502 corresponding to said like ramps 206 within the said inner surface of the housing 208. In a further example the said clutch inner surface 508 is substantially toothed 501. When the said handle is further operated in the said drive or locking direction D the said partially toothed 501 and smooth 504 inner surface 508 of the said clutch 500 having initially resiliently clamped the corresponding said toothed 401 profile of the said circumferential surface 405 of the said driven member 400 in order that when additional torque is applied in the said drive direction D to the said handle portion 30 the said clutch portion 500 is further urged inwards as the said clutch ramp protrusions 502 usefully engage the corresponding said inner housing ramps 206, further propelling the said inner surface 508 of the said clutch ring 500 inwards upon the said outer surface 405 of the said central drive portion 400, it's said spigot 408 and attached said socket 100 enabling the said correspondingly sized engaged fastener 80 to be robustly driven. In order to optimise the said clutch 500 initial said inner surface 508 grip upon the corresponding said drive portion 400 said outer circumference 405 the said toothed portion 501 of the said clutch 500 has said teeth 510 which interlock with the similar pitch and profile of the said drive teeth 401.

Operating the handle 30 in said reverse or reposition direction R the said actuator 34 releases its initial or direction biasing force clamping the said clutch inner surface 508 upon the said drive element circumference 405 provided by the said detent resilient portion 60, 61 acting to free the said clutch ring 500 from the said drive portion outer circumference 405. The action of the said drive portion 400 being rotated against the clamping friction of the said clutch ring 500 further rotates the said clutch outer ramps 502 away from the said corresponding housing ramps 206 allowing the said clutch ring 500 to expand negating the grip of the said clutch ring 500 upon the said driven member drive surface 405 usefully allowing the said drive portion 400 to be said reversed or repositioned R. The magnitude of the said clutch 500 engaging spring force is directionally proportionate to that of the said detent resilient portion 60, to that end the said clutch ring 500 generally requires to be thin in section and made from resilient material like high grade spring steel.

Figure 21:
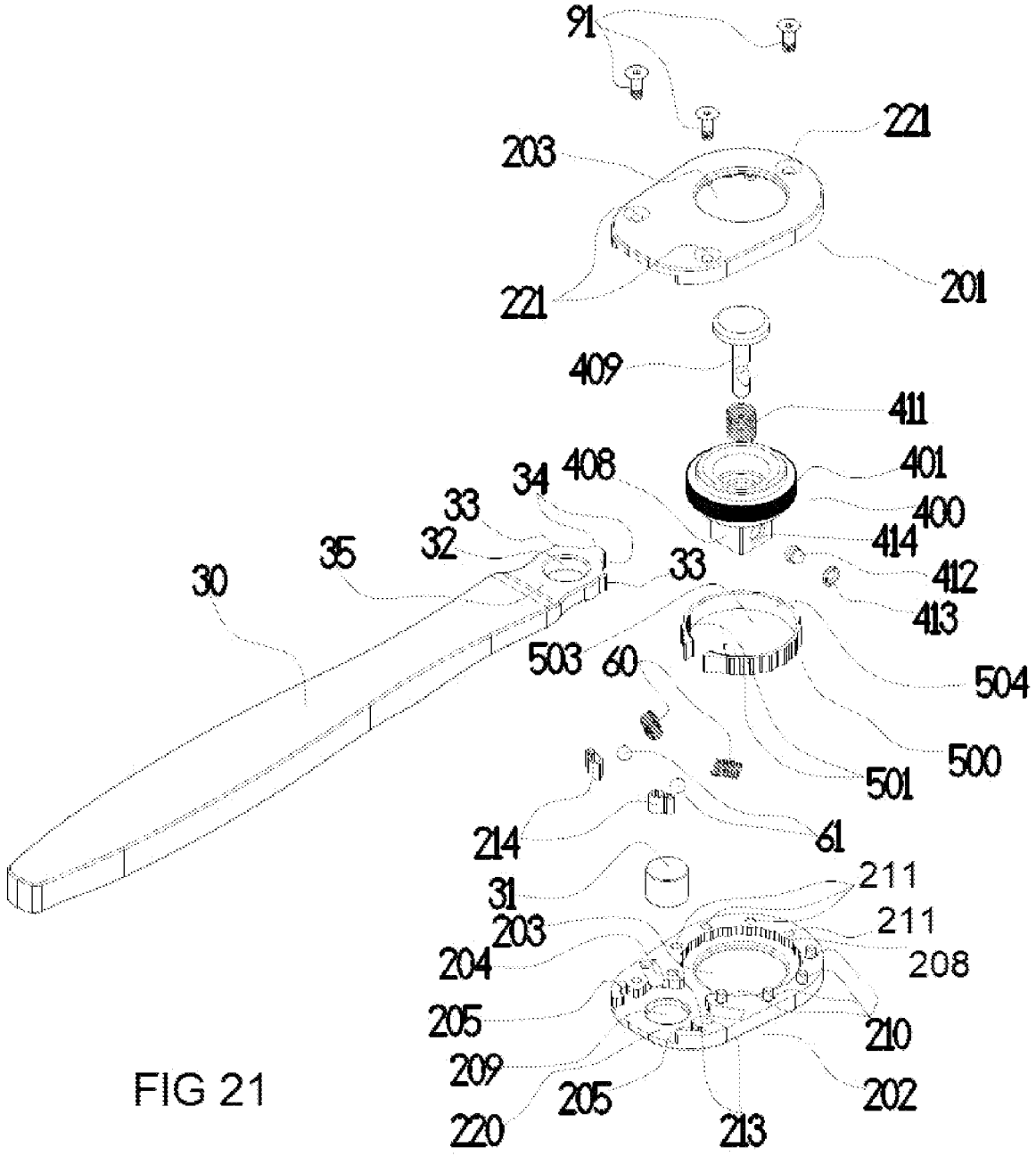
FIG. 21 is a perspective view of a low profile ratchet wrench.

FIG. 21 is a perspective view of yet another ratchet wrench 1. The ratchet wrench 1 shown in FIG. 21 has a relatively thin wrench head 200 when compared with the ratchet wrenches shown in FIGS. 1 and 2 and for convenience will be referred to a low profile ratchet wrench. The wrench head 200 comprises a housing made up of a top housing portion 201 and a bottom housing portion 202. The wrench head 200 further comprise a housing aperture 203, spring and ball channel 204, dust seal channel 205, housing inner surface 208, pivot pin recess 209, housing closure protrusions 210, housing closure holes 211, housing screw holes 213, housing dust seals 214, housing opening 220 and retaining screws 91.

The low profile ratchet wrench 1 further comprises a handle 30, handle pivot pin 31, handle pivot bore 32, biasing protrusion 33, actuator 34 and levered end 35. The said drive element 400, drive teeth 401, said drive spigot 408, said push button release 409, spring 411, spigot ball 412, ball retainer 413 and ball bore 414. The wrench head is provided with a clutch ring 500, clutch toothed portion 501, clutch smooth portion 504 and clutch aperture 503. The wrench head 200 is also provided with springs 60, balls 61 and screw fixings 91.

Figure 22:
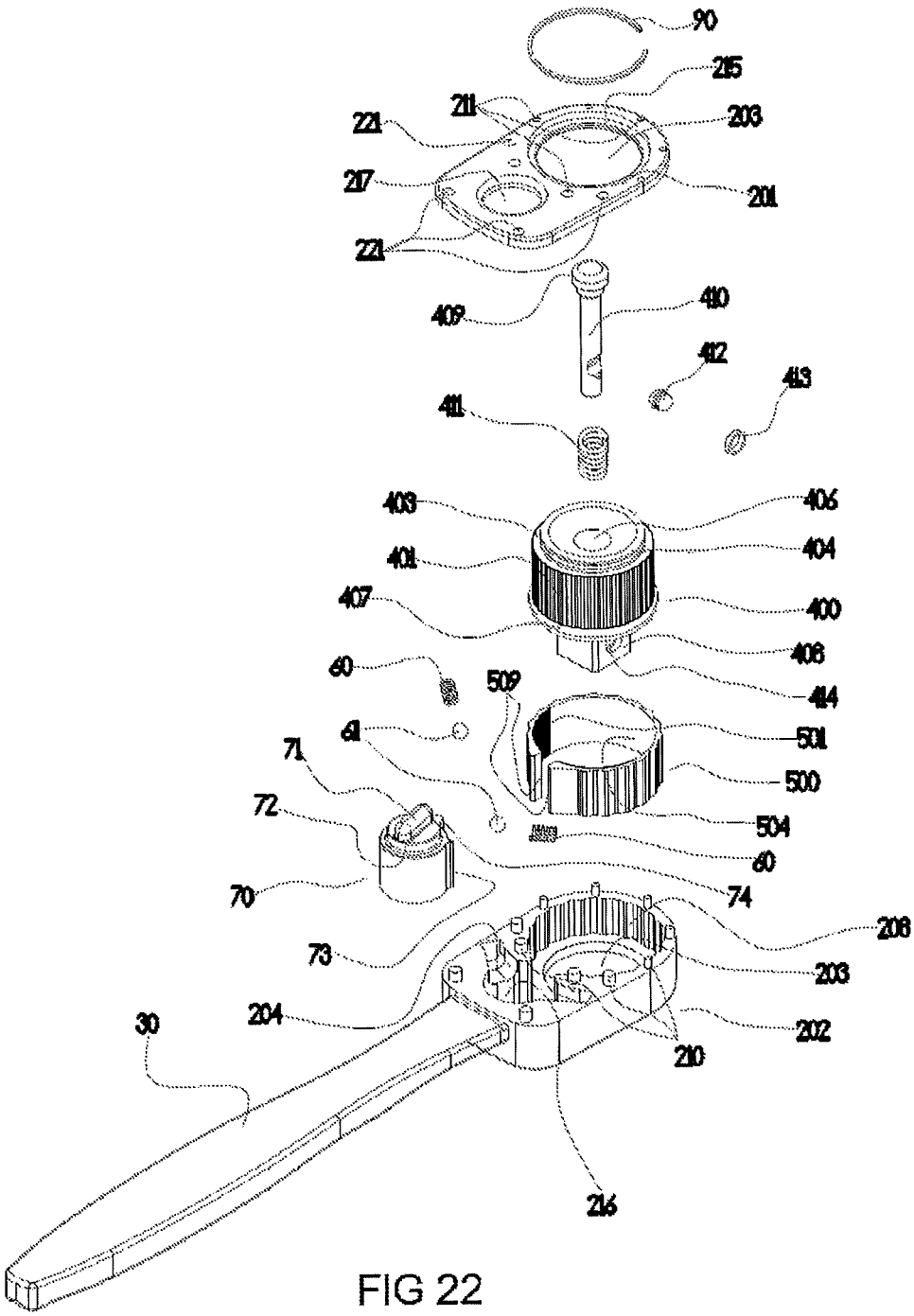
FIG. 22 is a perspective view of another low profile ratchet wrench.

FIG. 22 illustrates another low profile ratchet wrench 1 wherein a switch 70 is provided to set the torque applying direction of the wrench. The low profile ratchet wrench 1 of FIG. 22 comprises a wrench head 200 that includes a housing comprising a bottom housing portion 202 is directly attached to the handle 30 and atop housing 201 secured by a retaining clip 90 disposed within the drive retaining clip channel 404. The top housing portion 201 is secured to the bottom housing portion 202 by housing closure protrusions 210 held within housing closure holes 211. The wrench head 200 comprises a drive element 400 having a retaining flange 407, teeth 401, drive axle 403, spigot 408, push button 409 with its shaft 410 and bush button bore 406, spigot spring 411, spigot ball 412, spigot ball retainer 413 and spigot ball bore 414. The wrench head 200 has a clutch ring 500 that has a toothed portion 501 and a smooth portion 504. The said and bottom housing portions 201, 202 have a drive flange recess 215. The top housing portion 201 has a further switch axle bore 217 and the bottom housing portion 202 has a corresponding housing switch axle recess 216. The switch 70 has switch axles 72, biasing protrusions 73, actuator 74 and a finger grip 71. In use, the switch 70 is operated in the required direction, the biasing protrusions 73 act with the springs and balls 60, 61 within their spring and ball channel 204 to resiliently urge the switch actuator 74 against the respective clutch actuation face 509.

The low profile ratchet wrenches shown in FIGS. 21 and 22 may have ¼ inch square drive in combination with a housing having a depth of less than 7 mm, a ⅜ inch square drive in combination with a housing having a depth of less than 8 mm or a ½ inch square drive in combination with a housing having a depth of less than 11 mm.

The described and illustrated ratchet wrenches 1 are configured such that the clutch ring 500 forms the mid part of an extremely strong laminate like structure, under torque conditions the resultant compression forces applied to the said clutch ring 500 are substantially dissipated around its said circumference 507. The resultant pseudo laminate like construction of the said drive 400, clutch 500 and housing 201, 202 enables a proportionately far stronger or alternately a thinner lighter ratchet wrench 1, whilst still being made capable of passing the relevant torque standards.

The invention claimed is:

1. A ratchet wrench comprising:

a wrench head comprising a housing having an outer surface and an inner surface defining a housing aperture, said inner surface having a plurality of housing ramps;

a clutch ring disposed in said housing aperture, said clutch ring having first and second ends that each have an actuator face, said clutch ring having an outer surface and an inner surface that defines an aperture, said outer surface of said clutch ring having a plurality of transmission ramps and at least a portion of said inner surface of said clutch ring having a plurality of clutch teeth, wherein the number of said plurality of clutch teeth on said inner surface of said clutch ring is greater than the number of said plurality of transmission ramps on said outer surface of said clutch ring;

a handle having an and end defining an actuator that is situated between said actuator faces of said clutch ring and at least one biasing protrusion; and a drive element disposed in said clutch ring, said drive element having an outer surface and a spigot, said outer surface of said drive element comprising a plurality of drive teeth.

2. A ratchet wrench as claimed in claim 1, wherein there is a plurality of said clutch rings stacked in said housing aperture.

3. A ratchet wrench as claimed in claim 1, wherein said spigot is one of:

a ¼ inch square drive;

a ⅜ inch square drive; and a ½ inch square drive.

4. A ratchet wrench as claimed in claim 1, wherein said spigot is a bit holder.

5. A ratchet wrench as claimed in claim 1, wherein at least a portion of said inner surface of said clutch ring has teeth at said first end, and at least a portion of said inner surface of said clutch ring has a smooth surface.

6. A wrench ratchet as claimed in claim 1 wherein said actuator has a first position and a second position, in said first position a first biaser engages a first said biasing protrusion to cause said actuator to act on said actuator face of said first end of said clutch ring to pre-bias said transmission ramps against said housing ramps so that the wrench head is configured to apply a drive torque to said workpiece in a clockwise direction and to permit reverse rotation of said housing relative to said drive element in an anticlockwise direction, and in said second position a second biaser engages a second said biasing protrusion to cause said actuator to act on said actuator face of said second end of said clutch ring to pre-bias said transmission ramps against said housing ramps so that said wrench head is configured to apply a drive torque to said workpiece in an anticlockwise direction and permit reverse rotation of said housing relative to said drive element in a clockwise direction.

7. A ratchet wrench as claimed in claim 6, wherein when said wrench head is turned to apply said drive torque, said clutch teeth initially engage said drive teeth thereby causing said transmission ramps to move up said housing ramps to cause compression of said clutch ring onto said drive element.

8. A ratchet wrench as claimed in claim 6, when said housing is reverse rotated, said transmission ramps move down said housing ramps to allow said clutch to expand to cause said clutch teeth to disengage said drive.

9. A ratchet wrench as claimed in claim 6, wherein each said biaser comprises a spring and ball disposed in said housing.

10. A ratchet wrench as claimed in claim 6, wherein said first and second biasers and the first and second biasing protrusions are configured to selectively retain said actuator in said first and second positions.

11. A ratchet wrench as claimed in claim 1, wherein said housing comprises a top housing portion and a bottom housing portion and each of said top and bottom housing portions has housing closure protrusions and housing closure holes which interlock when said top and bottom housings are assembled.

12. A ratchet wrench as claimed in claim 1, wherein said housing is provided with a seal channel and at least one seal situated within said seal channel.

13. A ratchet wrench as claimed in claim 1, wherein said housing ramps have a length in a circumferential direction of said drive element, said clutch transmission ramps have a length in said circumferential direction and said housing ramps and said clutch transmission ramps have a common ramp angle in said circumferential direction that is in the range eight to thirty degrees.

14. A ratchet wrench as claimed in claim 1, having at least 40 said drive teeth.

15. A ratchet wrench as claimed in claim 14, having at least 120 said drive teeth.

16. A ratchet wrench as claimed in claim 1, wherein one of:

said spigot is a ¼ inch square drive and said housing has a width of less than 17 mm;

said spigot is a ⅜ inch square drive and said housing has a width of less than 20 mm;

said spigot is a ½ inch square drive and said housing has a width of less than 25 mm;

said spigot is a ¼ inch square drive and said housing has a depth of less than 7 mm;

said spigot is a ⅜ inch square drive and said housing has a depth of less than 8 mm; or said spigot is a ½ inch square drive and said housing has a depth of less than 11 mm.

17. A ratchet wrench as claimed in claim 1, wherein said housing ramps are disposed parallel to respective facing said clutch transmission ramps for complementary engagement by relative sliding movement.

18. A ratchet wrench comprising:

a wrench head comprising a housing having a switch recess, an outer sidewall and an inner sidewall defining a housing aperture, said inner sidewall having a plurality of housing ramps;

a handle connected with said wrench head;

a clutch ring disposed in said housing aperture, said clutch ring having a first end and a second end that has respective actuator faces, said clutch ring having an outer surface and an inner surface that defines an aperture, said outer surface having a plurality of transmission ramps, a portion of said inner surface having a plurality of clutch teeth and a portion of said inner surface being smooth, wherein the number of said plurality of clutch teeth on said inner surface is greater than the number of said plurality of transmission ramps on said outer surface;

a switch situated within said switch recess, said switch having an actuator situated between said actuator faces of said clutch ring, and at least one biasing protrusion; and a drive element disposed in said clutch ring and having an outer surface and a spigot, said outer surface of said drive element comprising a plurality of drive teeth.

19. A ratchet wrench comprising:

a wrench head comprising a housing having a switch recess, an outer surface and an inner surface defining a housing aperture said inner surface having a plurality of housing ramps;

a clutch ring disposed in said housing aperture and having a first end and a second end that have respective actuator faces, said clutch ring having an outer surface and an inner surface defining an aperture, said outer surface of said clutch ring having a plurality of transmission ramps, and at least a portion of said inner surface of said clutch ring being smooth, wherein the number of said plurality of clutch teeth on said inner surface of said clutch ring is greater than the number of said plurality of transmission ramps on said outer surface of said clutch ring;

a handle connected with said wrench head and having an actuator is situated between said actuator faces of said clutch ring, and at least one biasing protrusion; and a drive element disposed in said clutch ring and having an outer surface and an aperture, said outer surface of said drive element comprising a plurality of drive teeth.

20. A ratchet wrench as claimed in claim 19, wherein said aperture of said drive element is configured to receive attachments chosen from a group comprising an adapter, bit, and socket.

21. A ratchet wrench as claimed in claim 19, wherein said aperture of said drive element is configured to directly engage fasteners.

* * * * *